US007176366B1

(12) United States Patent
Bruce

(10) Patent No.: US 7,176,366 B1
(45) Date of Patent: Feb. 13, 2007

(54) ADJUSTABLE MUSICIAN'S EQUIPMENT STAND

(76) Inventor: Harper M. Bruce, 211 Becca La., Stroudsburg, PA (US) 18360

( * ) Notice: Subject to any disclaimer, the term of this patent is extended or adjusted under 35 U.S.C. 154(b) by 0 days.

(21) Appl. No.: 11/183,558

(22) Filed: Jul. 18, 2005

Related U.S. Application Data

(63) Continuation-in-part of application No. 10/823,092, filed on Apr. 13, 2004, now Pat. No. 7,131,615, which is a continuation-in-part of application No. 10/145,051, filed on May 14, 2002, now Pat. No. 6,720,490.

(51) Int. Cl.
*G10D 3/00* (2006.01)

(52) U.S. Cl. ..... 84/327

(58) Field of Classification Search ..... 84/327, 84/421, 329, 443; 248/443
See application file for complete search history.

(56) References Cited

U.S. PATENT DOCUMENTS 3,958,786 A * 5/1976 Mann ..... 248/176.3
5,497,689 A * 3/1996 Hoshino ..... 84/327

* cited by examiner

*Primary Examiner*—Kimberly Lockett
(74) *Attorney, Agent, or Firm*—Charles A. Wilkinson; Clinton H. Wilkinson

(57) ABSTRACT

A stand for holding a musical accessory at a convenient level having a base comprised of a plurality of adjustable telescoping members forming a U-shape base support, which can be adjusted to extend around other equipment in a crowded stage area, thereby conserving space and enabling the stand to be conveniently situated closely together with such other equipment, and in addition being used as an instrument and equipment support stand that can be compacted into a convenient small package for purposes of storage and transport.

10 Claims, 20 Drawing Sheets

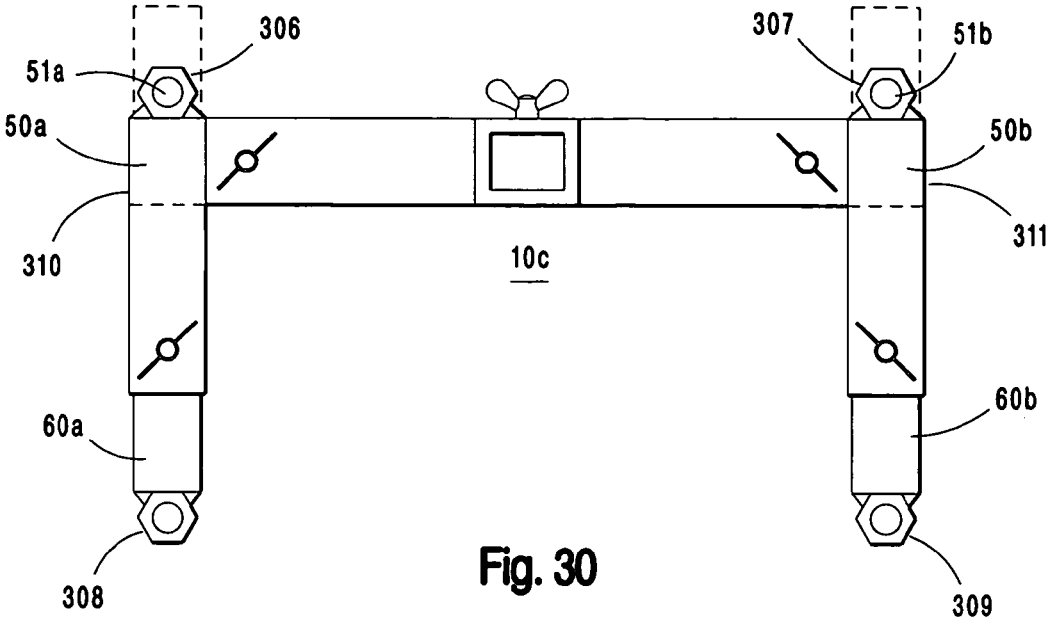
Fig. 30
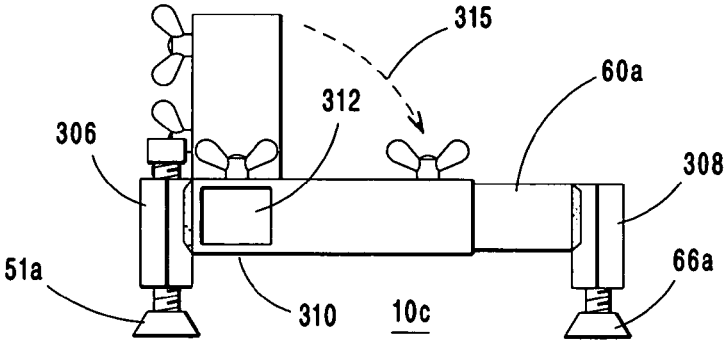
Fig. 31
Fig. 32
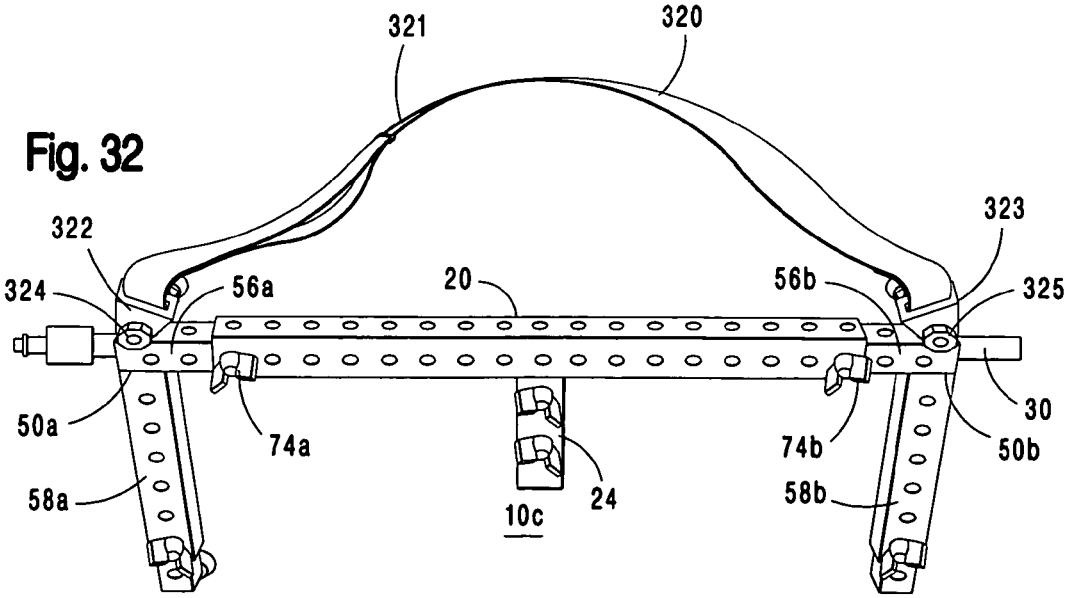

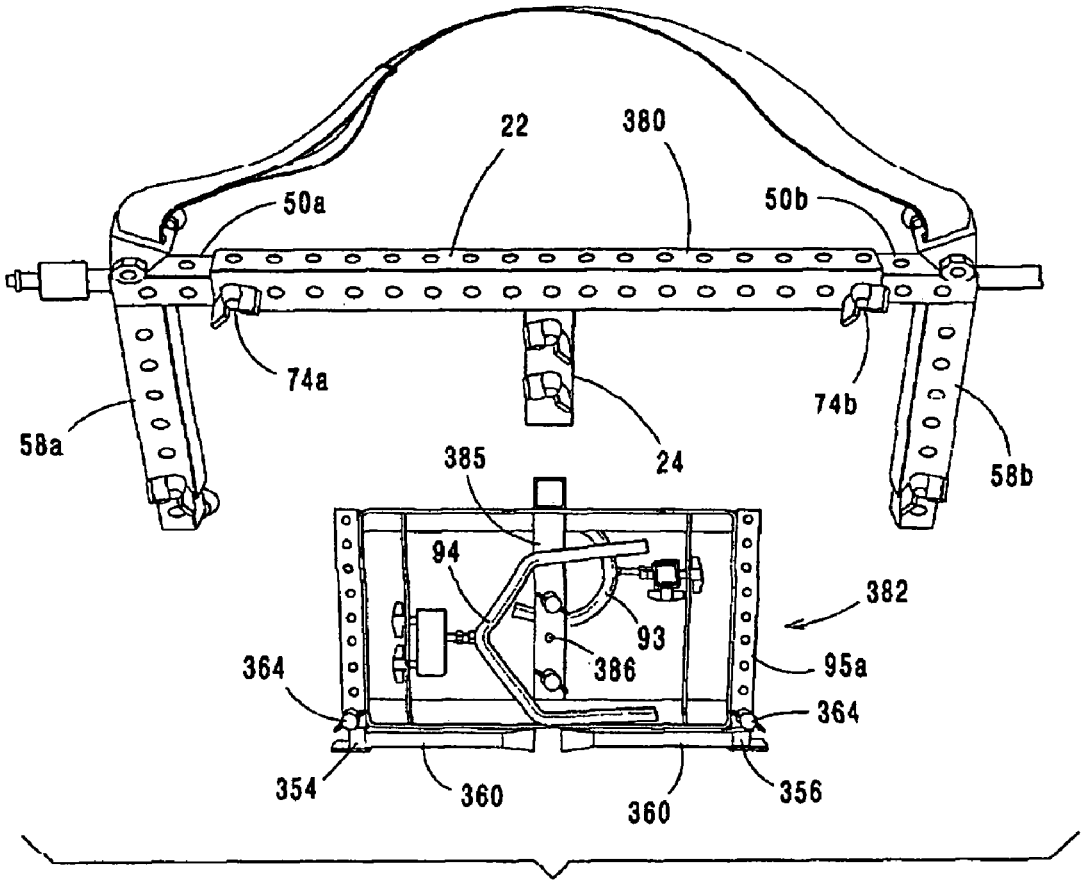
Fig. 37
Fig. 38
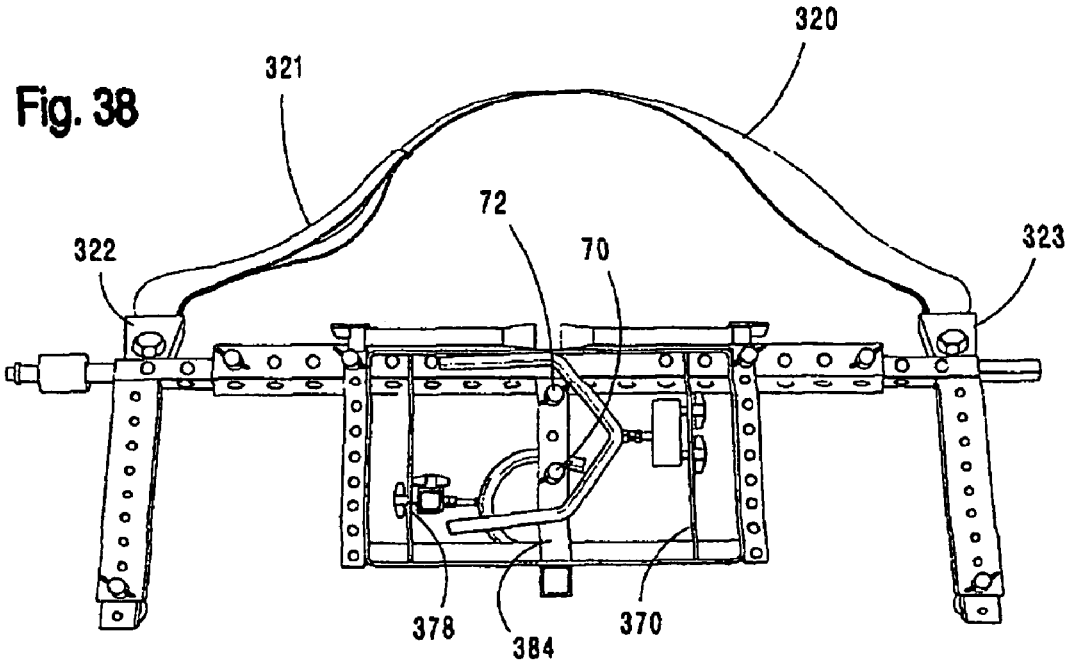

ADJUSTABLE MUSICIAN'S EQUIPMENT STAND

CROSS REFERENCE TO RELATED APPLICATIONS

This application is a Continuation-in-Part Application based upon and taking priority from U.S. patent application Ser. No. 10/823,092, filed on Apr. 13, 2004 now U.S. Pat. No. 7,131,615, which is based upon and taking priority from U.S. patent application Ser. No. 10/145,051 filed on May 14, 2002, now U.S. Pat. No. 6,720,490.

BACKGROUND OF THE INVENTION

1. Field of the Invention

The present invention relates to equipment stands used by musicians, and more particularly to stands for microphones, music, instruments and amplifiers, and more particularly still to a stand having a horizontally adjustable base particularly for use on a crowded stage or performing area and capable of extending around floor supported musical equipment as well as supporting various musical instruments and musical accessories that folds into a compact and easily carried and transported configuration.

2. Preliminary Discussion

Individual musicians such as guitarists or vocalists, as well as musical groups or bands, often perform in venues such as clubs, bars and the like where the stage or performing area is quite small. For example, many corner bars or clubs do not even have a separate stage area, and performers must clear an area of tables, chairs and other like items prior to setting up their equipment. In such situations, there is barely room for a band having several members to set up such equipment, which typically includes several microphone stands, amplification equipment, control processors, a keyboard, drum set and the like. In addition, after such equipment has been set up, there may be little room left over for the band members to move around during their performance, as they typically may desire. Even in clubs having larger performing areas, space is still at a premium, since most band members prefer to be able to move around the stage freely without having to worry about tripping over or running into their equipment.

Performers who both play an instrument, such as an electric guitar, while also providing vocals' encounter a slightly different space problem. Particularly where there is a limited area to move around, such performers will often remain in a more or less stationary position. However, it can be difficult to orient both a foot controller or processor equipment for an electric guitar and a microphone or music stand so that both are in sufficiently close proximity to the performer so that they can be reached without the performer having to continually change or shift positions. This difficulty is largely due to the shapes of such equipment. A typical microphone stand is comprised of a vertically adjustable telescoping pole connected to a round, weighted base situated directly beneath the pole, and is normally placed more or less directly in front of the performer so that the microphone is in close proximity to the performer's face and mouth whenever vocals are required. Electronic guitar foot controls or processing equipment are usually enclosed in a generally rectangular holder or box-like structure which also must be placed in close proximity to the performer so that such foot controls can be comfortably reached by the performer without requiring him or her to shift positions or move away from the microphone. However, placement of the round microphone stand base directly in front of the performer leaves little room for the foot controller. This conflict can adversely affect the quality of the performance, since the microphone and foot controls often may be required to be used simultaneously. The instant invention attempts to overcome this conflict by providing a microphone stand having a base that can be horizontally adjusted for placement around a foot controller or other objects, permitting both the microphone and foot controls to be directly in front of, and therefore within easy reach of, the performer.

In addition, there is frequently other equipment to support as well as floor equipment which is conveniently bracketed by any equipment stands necessary to support elevated equipment and the present music accessories stand is particularly designed to support such equipment while conserving floor space.

3. Description of Related Art

Numerous examples of arrangements for stacking and folding microphone or music stands, or for adjusting the height of such stands, are known in the prior art. In addition, other types of music equipment such as electronic keyboards are usually provided with a support or frame structure. However, the inventor is not aware of a stand for holding a microphone, sheet music, or a small instrument such as a harmonica or large equipment or instruments which stand can be horizontally adjusted to be situated around other equipment used by a musician, such as a foot controller or audio amplifier, thereby making it easier to simultaneously use such equipment while also conserving space in a small or cramped stage area.

For example, U.S. Pat. No. 4,067,527 issued Jan. 10, 1978 to J. L. Streit entitled "Musical Instrument Support Stand With Counter-Balanced, Vertically Movable Horn Support Rack," discloses a stand having a generally U-shaped base when unfolded and in which the legs are folded parallel to the base when not in use.

U.S. Pat. No. 4,407,182 issued Oct. 4, 1983 to A. R. Biasini entitled "Musical Instrument Stand," discloses a tripod-like stand having telescoping legs which collapse during storage, but are meant to be fully extended during use and collapsed when not in use when they are stored in the hollow bottom.

U.S. Pat. No. 4,445,415 issued to G. J. Izquierdo on May 1, 1984, entitled "Portable Case and Stand for Pedal Controls Operationally Fixed Therein for use with a Keyboard Temporarily Mounted Thereon," discloses a box structure having several pedal controls for an electronic keyboard permanently mounted therein, which structure is also used to support an electric keyboard. Izquierdo is an example of a time and space-saving arrangement wherein the pedal controls can be situated underneath or in a music stand. However, instruments such as an electronic keyboard, which are elongated in shape, intrinsically have a space provided underneath such instrument for placement of the legs of the user, while stands for sheets of music, a microphone, or instruments such as a harmonica or drum machine typically do not provide such space.

U.S. Pat. No. 4,449,010 issued to F. L. Seebinger on May 15, 1984, entitled "Multi-Position Microphone Stand Support Assembly," discloses a support for a microphone wherein the vertical support column is pivotable, while the base remains stationary. Such stand allows for more than one microphone to be attached to the support, but does not disclose a horizontally adjustable base.

U.S. Pat. No. 4,718,624 issued to R. G. Greulich on Jan. 12, 1988, entitled "Folding Microphone Stand," discloses a tripod-type stand in which the support column can be pivoted on the base member, and having an aperture in the base member to accommodate the support column in a fully folding position. Pivoting the support column in relation to the base allows for easier transport or storage of the stand when it is not in use. However, in general folding tripod-type microphone stands are not preferred because they pass unwanted vibrations to the microphone.

U.S. Pat. No. 5,048,789 issued to D. H Eason et al. on Sep. 17, 1991, entitled "Microphone Stand," discloses a stand having a generally circular base and a U-shaped cutout portion so that several of such bases can be overlapped or stacked when stored. Eason et al. illustrates several other embodiments in which the base portion has a slightly different configuration while still retaining its stackable characteristics. However, none of such embodiments illustrates a base, which can be horizontally adjusted so as to fit around equipment such as a foot controller.

U.S. Pat. No. 5,090,648 issued to W. R. Wood, IV on Feb. 25, 1992, entitled "Stand Assembly," discloses a stand for holding doors, windows, and the like during painting. The base members of the Wood stand do not appear to be adjustable, however.

U.S. Pat. No. 5,106,048 issued to M. Lebar et al. on Apr. 21, 1992, entitled "Support Stands" discloses a music stand having tripod-type support legs wherein two of the legs are pivotable so that the legs can be folded in a storage position. Tripod-type support stands are well known in the prior art and may possibly be placed over or around a foot controller, but are not adjustable in the same manner as the present invention.

U.S. Pat. No. 5,149,901 issued to M. C. Boor et al. on Sep. 22, 1992, entitled "Guitar Support Apparatus," discloses a support for a guitar having a pair of parallel pipe-like legs with vertically extending supports spaced thereon.

U.S. Pat. No. 5,340,066 issued to K. J. Ditch on Aug. 23, 1994, entitled "Stand for Article," discloses another tripod-type adjustable microphone wherein one leg has incorporated a tilt assembly, which allows the angle of the microphone to be adjusted.

U.S. Pat. No. 5,611,508 issued to A. Palmero on Mar. 18, 1997, entitled "Horizontally Adjustable Microphone Support," discloses a microphone support having a telescoping horizontal cross member attached to the upper end of the vertical support column. The base member in Palmero, however, is a typical round base and is not adjustable.

U.S. Pat. No. 5,857,649 issued to D. H. Eason on Jan. 12, 1999, entitled "Stabilizing and Memory Musical Instrument Stand," discloses a music stand having a support frame shaped as a cross-frame which is pivotable about the intersection of the frame members.

U.S. Pat. No. 5,863,015 issued to H. Hsu on Jan. 26, 1999, entitled "Microphone Stand Elevating Device, discloses a device which makes it easier to upwardly or downwardly adjust the height of a microphone support column extending from the base of a microphone stand, although the configuration of the base cannot be adjusted.

U.S. Pat. No. 5,893,541 issued to D. Michaelson on Apr. 13, 1999, entitled "Microphone Stand Providing Quick Assembly and Disassembly," discloses an improved means for quickly assembling and disassembling a support column from a microphone stand base. The base, however, is made from a single generally oval solid structure and is not adjustable.

U.S. Pat. No. 6,215,054 issued to K. S. Woodhouse et al. on Apr. 10, 2001, entitled "Musical Instrument Support Stand," discloses a stand having telescoping legs which are secured in position using finger screws, in which the legs of the stand all extend outwardly from a central hub.

U.S. Pat. No. 6,215,056 issued to T. Liao on Apr. 10, 2001 entitled "Adjustable Foot Structure for Hi-Hat Cymbal," discloses a cymbal stand having an adjustable foot member attached to the bottom of a stand member.

Despite the numerous microphone and music stands known in the prior art, each of which provides its own degree of utility, there is a need for a stand having a base portion which incorporates usable space in the center and which can be adjusted to conserve space on a cramped or crowded stage or performing area so as not to interfere with the placement of other music or performing equipment.

OBJECTS OF THE INVENTION

It is therefore a primary object of the invention to provide a stand for holding a microphone, sheet music, instrument, guitar, amplifier, or the like.

It is a further object of the invention to provide a stand providing floor space in the center portion of the base of the stand to accommodate music or other performing equipment.

It is a further object of the invention to provide a stand having a base portion comprised of a plurality of telescoping members which are independently adjustable.

It is a still further object of the invention to provide a stand wherein the telescoping members can be adjusted so as to surround or avoid other music equipment or control boxes on a stage floor such as speakers, foot controllers or effects processors.

It is a still further object of the invention to provide a stand which requires a minimum amount of space on a stage or performing area.

It is a still further object of the invention to provide a stand providing floor space in the center which can be used in various locations about a musician on a crowded stage.

It is a still further object of the invention to provide a base which can be used to support a microphone stand, music stand, or instrument.

It is a still further object of the invention to provide a base which can accommodate support of several different instruments.

It is a still further object of the invention to provide a base for a microphone, instrument, or music stand which can be easily and quickly set up and stored and carried in a compact configuration when not in use.

Still other objects and advantages of the invention will become clear upon review of the following detailed description in conjunction with the appended drawings.

SUMMARY OF THE INVENTION

A stand for use as a microphone stand, music stand, or instrument stand is provided having a telescopingly adjustable base arrangement which is designed to be used particularly in relatively cramped stage or performing areas where there is a need to conserve space, although such arrangement could be used in any performing area. Performers, particularly those musicians or bands performing in a small club or bar environment, often encounter a problem in that there is insufficient room to set up all of their electronic equipment in a reasonably effective manner. The present invention addresses this problem by providing a stand having a generally U-shaped frame or support providing floor space within the center of the "U" and wherein the length of the support members is adjustable so that the support members can be positioned compactly around other equipment such as processors or controllers, thereby more efficiently using the available floor space in setting up such equipment. The pitch or angle of the vertical microphone support column can be adjusted using screw-type foot members on the bottom of the stand. In addition, the foot members provide sufficient room between the floor and horizontal support members so that electric control wires powering the effects processor, instruments, or other equipment can be slipped under such members. The stand can be used not only to accommodate or hold a microphone before a musician on a crowded or cramped stage, but to accommodate an instrument in back of or toward either side of a musician as well as other equipment, such as an amplifier, for which a further pair of telescoping support legs may be provided. The stand as well as the instrument and equipment support features also may be simply and quickly folded or compacted into an easy to carry package for transportation and storage purposes.

BRIEF DESCRIPTION OF THE DRAWINGS

FIG. 30 is a top view of another preferred embodiment of the stand base of the present invention.

FIG. 31 is a side view of the embodiment of the stand base of the present invention shown in FIG. 30.

FIG. 32 is an elevation front view of the stand base shown in FIGS. 30 and 31 in a compact or storage position.

FIG. 37 illustrates the apparatus shown in FIGS. 33–36 compacted into the stand base and rod section and instrument and equipment support sections.

FIG. 38 illustrates the apparatus as shown in FIG. 37 with the stand base and rod section and instrument and equipment support sections being a single package.

DESCRIPTION OF THE PREFERRED EMBODIMENTS

Figure 1:
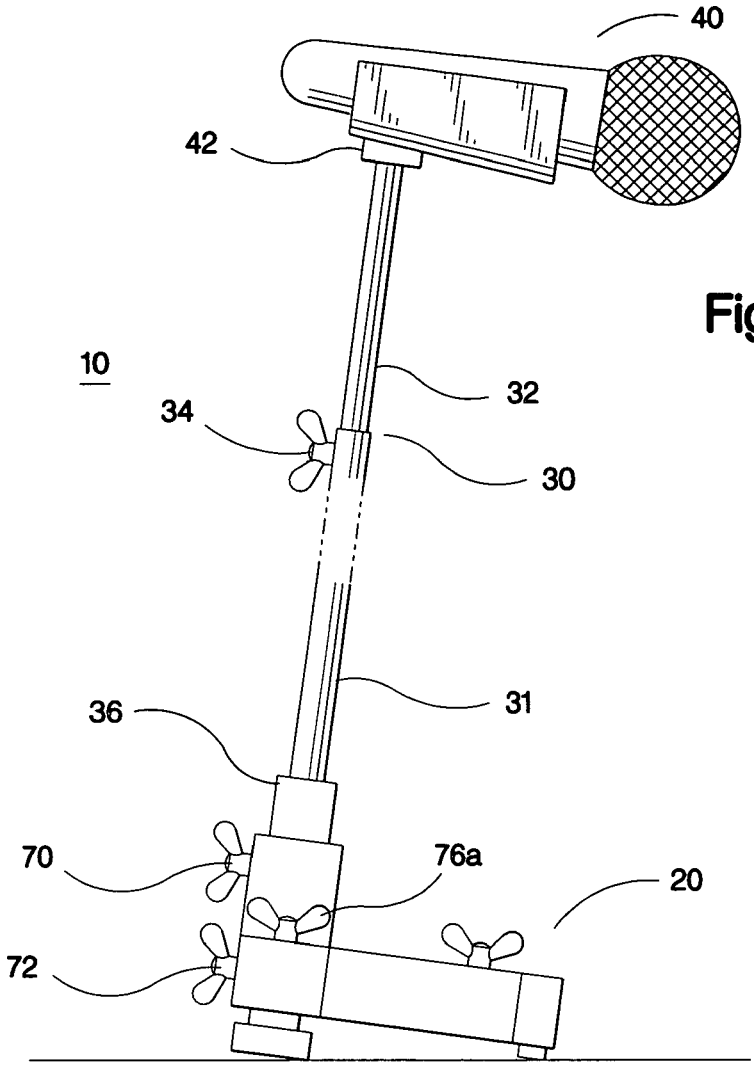
FIG. 1 is side elevation of the stand of the present invention.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

It is frequently necessary or desirable to situate control pedals and other control equipment for loud speakers and other musical, performance and special effects equipment directly in front of a performer, which performer usually is also using a microphone or the like in his or her musical or other artistic performance. In a very large music hall or similar performing environment, there are usually sound men and other technical personnel to handle the operation of sound equipment, modify its effects from time to time as necessary, and generally monitor and adjust the rendition of any performance. A lone performer before smaller audiences, on the other hand, must modify the sound and musical effects him or herself and, since such performer cannot or should not, from an artistic viewpoint, be seen continually adjusting various knobs, dials, switches and the like, foot control pedals are usually provided to allow the performer adequate control of the technical aspects of sound control. Operation of such foot controls is not as visible and distracting to an audience as hand manipulation would be, and frequently an artists hands are otherwise occupied in any event. The most convenient and logical location for such foot control and other equipment is directly in front of the performer. However, where the performer is using a standup microphone, as is frequently necessary, if the artists hands are busy, the microphone base must also be in front of the performer unless the microphone can be supported on a pivoted or counterbalanced beam or pole arrangement from the side, which is sometimes done, or can be hung from the ceiling of the performing area, which is seldom possible in smaller or more general, as distinguished from, professional or specialized performing facilities. Consequently, there is considerable agonizing, adjusting and improvising by an artist before each performance trying to arrange the floor equipment such as foot controls and the like and the base of microphones and the like with respect to the performer. Not only is this improvising period time-consuming, but it also is tension-inducing for the performers and distracting during actual performance. The present inventor, having been presented as a performer with the problem, has ingeniously solved it by providing not only a microphone stand providing floor space in the center directly under the microphone, but one that is freely adjustable so that such stand can be readily adapted to performing equipment of various dimensions while maintaining the floor space taken up by the various equipment at a minimum. Thereby, a very significant problem for performers has been solved in a simple and expedient manner.

The same problem which occurs with microphone bases also frequently occurs with respect to music stands, instrument stands where an instrument must be partially supported or where a single musician must take up alternative instruments during a performance, and in such cases the present invention provides an open base stand with adjustable lateral dimensions which may be used also with great effectiveness. The stand of the invention or base for a stand of the invention is particularly useful also where the stage or performing area is cramped and lacking in space as very many less professional performing areas are.

The inventor has now also discovered that his basic microphone base which provides room at the center of the base for foot controls and the like, as shown and described in his previous application with respect to which this application is a continuation-in-part, can also with little or no substantial modification be used to support holders for instruments behind or to the sides of the performer and can in the same manner surround a loudspeaker or amplifier equipment behind the performer. The inventor has designed further attachments for his stand and base including an improved arrangement for decreasing the dimensions of the folded base for storage and transportation between appearances of the artist.

Reference will now be made in detail to a presently preferred embodiment of the invention as illustrated in the accompanying drawings. Whenever possible, the same reference numbers will be used throughout the drawings to refer to the same or like parts.

Figure 2:
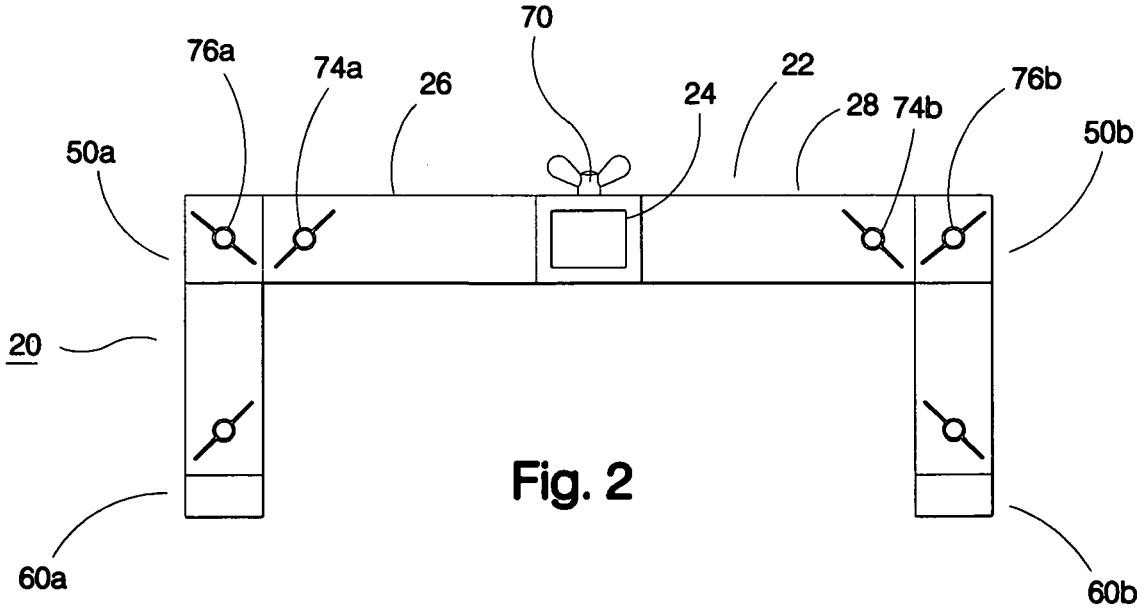
FIG. 2 is a top or plan view of the base portion of the stand of the present invention.
Figure 3:
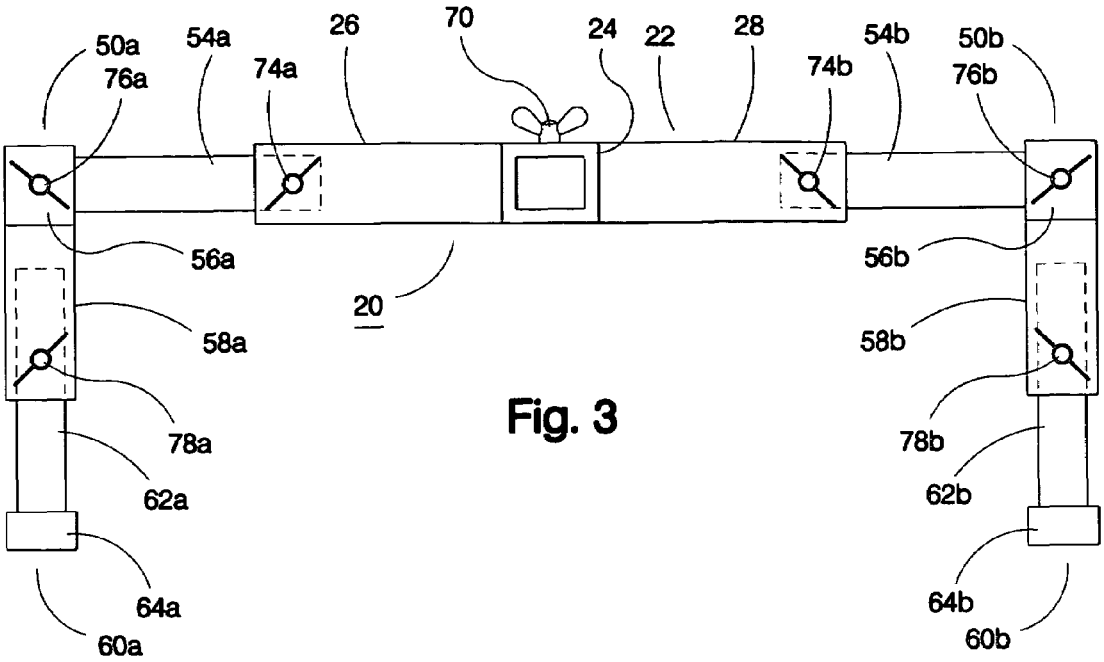
FIG. 3 is a top or plan view of the base portion of the stand similar to FIG. 2 with the individual telescoping base members extended to or toward their maximum.
Figure 4:
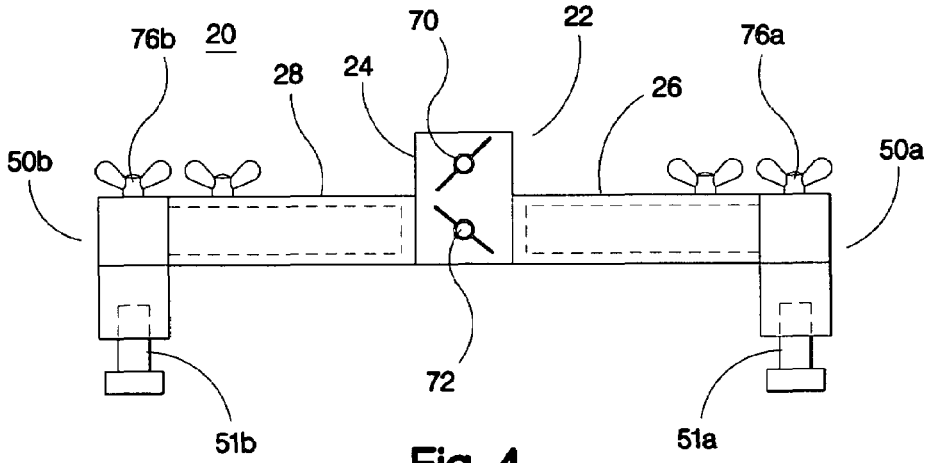
FIG. 4 is a rear view of a slightly alternative version of the base, as it would originally be viewed from the audience side.
Figure 5:
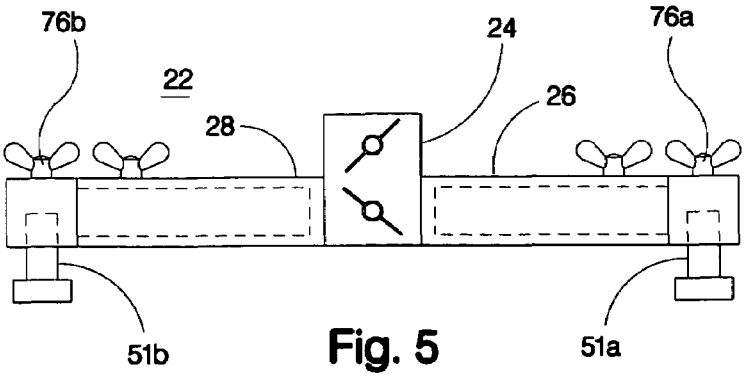
FIG. 5 is a rear view of the base as shown in FIGS. 1–3, as it would normally be viewed from the audience side.
Figure 6:
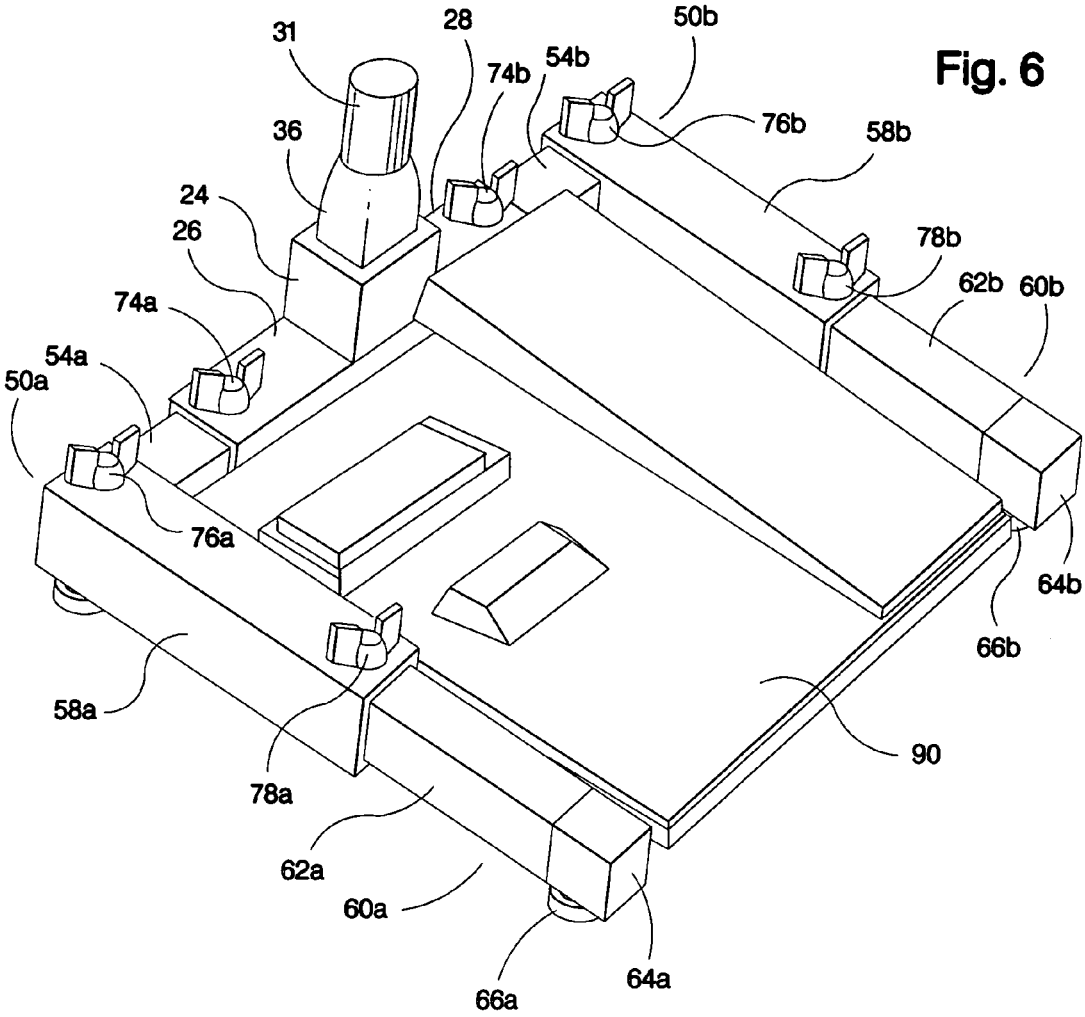
FIG. 6 is an isometric view of the base surrounding a typical foot control device.
Figure 7:
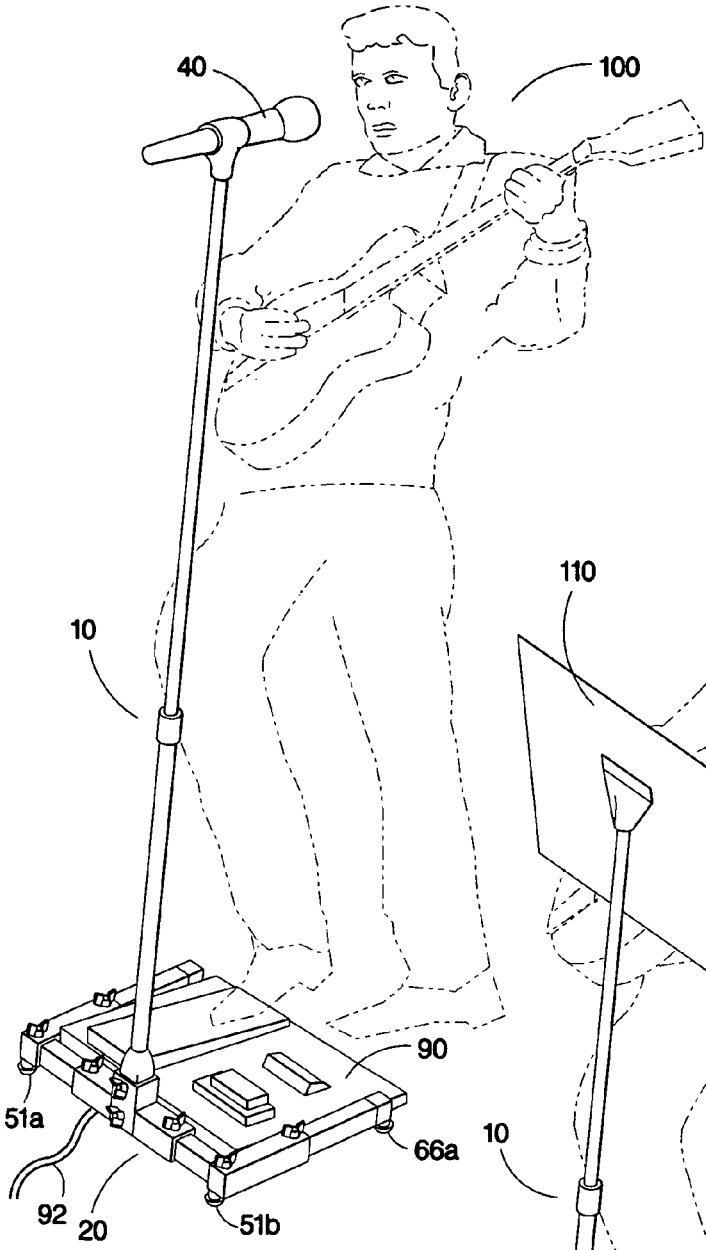
FIG. 7 is an isometric view of an artist using a microphone mounted on the stand of the invention shown in FIG. 5.
Figure 8:
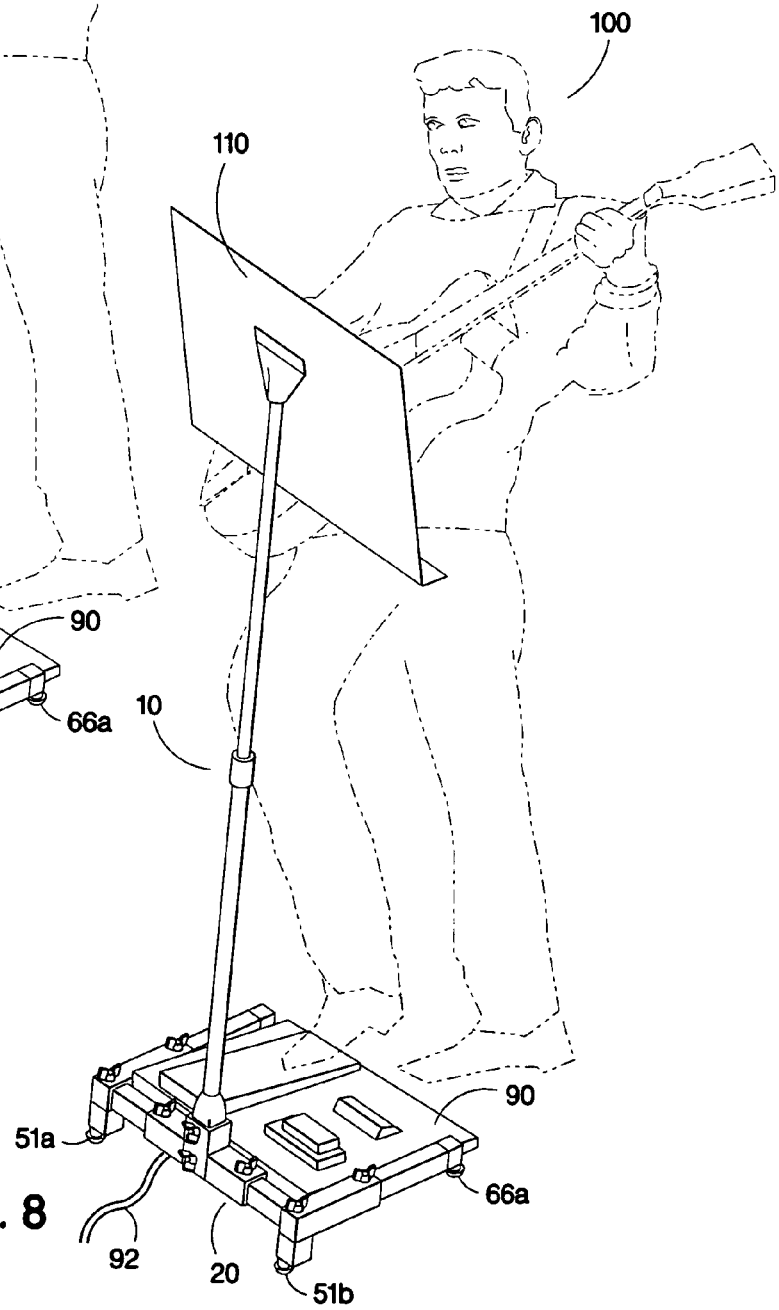
FIG. 8 is an isometric view of an artist using the stand of the invention shown in FIG. 4 as a music stand.

FIGS. 1–9 illustrate a first preferred embodiment of the invention, with FIGS. 4 and 8 illustrating a slightly alternative embodiment, while FIGS. 10–15 illustrate another possible alternative embodiment, FIGS. 16–29 illustrated another alternative embodiment, while FIGS. 30–3*x* illustrate yet another alternative embodiment. FIG. 1 is a side elevation view of the first preferred embodiment of the adjustable musician's stand 10 of the present invention. While such example of the invention illustrates the stand 10 supporting a microphone 40, it is envisioned as well as illustrated in the alternative embodiments below that the stand 10 can also be used as a music stand, instrument or equipment support stand, or the like. In addition, the scale of FIG. 1 may appear distorted because the microphone 40 appears large compared to the microphone support rod or member 30. However, support rod 30 should be understood to be considerably longer, it having been foreshortened in the figure by not showing a central section indicated by dotted lines, and in actuality, the usual microphone support rod will be three or four times as lengthy and usually telescopically adjustable as described below. A typical microphone supported on a stand in accordance with the invention in use by a performing artist is shown in FIG. 7.

Referring still to FIG. 1, stand 10 is generally comprised of a base 20 supporting or being coupled to a vertically extending post or support member 30, with microphone 40 secured on the upper end of support member 30 by bracket or clip 42. Microphone cable clips, not shown, may also be situated on support member 30 to secure a microphone cable, also not shown. A swiveling boom may also be provided as is known in the prior art. Preferably, the height of support member 30 is telescopingly adjustable, and is comprised of an outer telescoping member or portion 31 which is secured at its lower end in base 20, and an inner telescoping member or portion 32. The relative position of such members can be fixed at a desired height or position by a threaded locking mechanism 34 such as a threaded wing nut fastening of a type known in the prior art located on the upper end of outer member 31, whereby relative movement between the telescoping members during use is prevented and the length of the vertical support member 30 is temporarily fixed or maintained as desired. Alternatively, as illustrated generally in FIGS. 7 and 8, inner telescoping member 32 can lock in position by rotating inner member 32 in relation to outer telescoping member 31, or various other clamping means known to those skilled in the art can be used.

FIGS. 2–5 illustrate in various views and with various orientations the supporting base 20, while FIG. 6 illustrates the base 20 surrounding a typical foot controller device designated by reference number 90. As will be shown below, the supporting base 20 of the inventor's stand 10 is constructed with a U-shaped frame so that the center portion is relatively open, thereby leaving room for other equipment to also be placed directly in front of the performer. In addition, the legs of supporting base or base central extensions 22 are also horizontally adjustable, so that the base of the stand can be more easily and efficiently arranged around other equipment on a crowded stage. In addition, each of the base support members can be detached from the stand 10 or otherwise adjusted for easier storing or carrying.

Still referring to FIGS. 2–5, base 20 is comprised generally of hub or central portion 22, first and second telescoping or extensible corner members 50*a* and 50*b*, and first and second telescoping or extensible leg members 60*a* and 60*b*. In combination, such parts form a generally U-shaped frame or supporting base having an open center and enable base 20 to be situated in a finite number of different generally horizontal configurations so that the stand 10 does not interfere with the placement of other electronic equipment on a stage or performing area directly in front of the performer. Each of such parts is preferably made from the same material, which can be any suitable material such as anodized aluminum, hard plastic, steel or the like.

Upwardly facing stand socket 24 is situated generally at the midpoint of central portion 22. As is most clearly shown in FIGS. 1 and 4, outer portion 31 of telescoping microphone support 30 is placed in and coupled to socket 24 by threaded securing members 70 and 72. While stand socket 24 is shown in the FIGS. as having a rectangular shape to accommodate the rectangular base of coupling member 36 on the bottom of the outer portion 31 of microphone support rod 30, such socket 24 can be in any shape depending primarily upon the shape of a particular coupling member. In addition, coupling member 36 may be either a permanent part of the support rod 30 or may be slip fitted over the bottom of the support rod 30. Socket 24 is preferably coated with a rubber material that acts as a barrier to prevent floor vibrations from passing through the stand and support rod to the microphone, thereby greatly reducing the risk of feedback vibrations interfering with the quality of the sound.

First and second outer sleeves 26 and 28 of central portion 22 extend horizontally from opposite sides of sleeve or stand socket 24, while corner members 50*a* and 50*b* are telescopic coupled in sleeves 26 and 28. As best shown in FIG. 3, corner member 50*a* is comprised of first inner sleeve 54*a*, corner piece 56*a*, and, aligned perpendicular to first inner sleeve 54*a*, outer sleeve 58*a*. Similarly, corner member 50*b* includes second inner sleeve 54*b*, corner piece 56*b*, and, aligned perpendicular to second inner sleeve 54*b*, outer sleeve 58*b*. See FIG. 3, which shows the inner sleeves extended and therefore visible. First and second inner sleeves 54*a* and 54*b* are sized to telescopingly couple within first and second outer sleeves 26 and 28 on central portion 22, respectively. Threaded screw members 74*a* and 74*b* are adjustably secured in threaded apertures generally near the outer ends of sleeves 26 and 28, respectively, for jam holding inner sleeve sections 54*a* and 54*b* in position with respect to outer sleeves 26 and 28. Although parts 54*a*, 56*a*, and 58*a*, and 54*b*, 56*b*, and 58*b*, respectively, are labeled separately, preferably they are integrally made as a single cast or otherwise single fabricated piece. In addition, in each case, the threaded screw members are shown as having a wing nut on the exterior of an underneath threaded fastening to jam against a sliding section below to maintain the sections in position with respect to each other. However, the wing section could also be a hexagonal or other head fastener or bolt adapted to impinge against the adjacent member and jam fit the two together. Other suitable fasteners could also be used. Hand screw members 76*a* and 76*b* are threadably secured in apertures on the top face of corners members 50*a* and 50*b*, respectively, while screw members 78*a* and 78*b* are threadably secured in apertures near the outer ends of sleeves 58*a* and 58*b*, respectively, to maintain the inner sleeves 54*a* and 54*b* in the end pieces 50*a* and 50*b*. Ground engaging or foot members 51*a* and 51*b*, shown in FIGS. 4 and 5, are located on the bottom side of corner pieces 56*a* and 56*b* to actually support the front of the base 20 on an underlying support surface. Such foot members may be fixed on the bottoms of corner members 50*a* and 50*b* or may preferably be adjustable with respect to the corner members. Suitable adjustment may be obtained by thread attachment into the corner members or alternatively by the use of threaded type jam fittings, not shown, in the end of the corner pieces.

First and second leg members 60*a* and 60*b* are comprised of inner telescoping members 62*a* and 62*b* having connected on their outer ends members 64*a* and 64*b*. Inner telescoping members 62*a* and 62*b* are sized to extensibly or telescopingly couple with outer sleeves 58*a* and 58*b*, respectively. In addition, as shown in FIG. 6, adjustable screw-type foot members 66*a* and 66*b* are preferably threadably secured to the bottom side of end members 64*a* and 64*b* so that the pitch or angle of the vertical microphone support column can be adjusted. In most cases, support member 30 is preferably angled towards a musician playing an instrument so that the stand does not interfere with the playing of such instrument held in front of the musician. A further angle or pitch to the support column can be provided by increasing the height or depth of corner members 56*a* and 56*b*, as shown in FIG. 4, or by adding as shown an additional piece onto the bottom side of corner members 56*a* and 56*b*, as illustrated in FIG. 8. Such arrangement also provides room for heavier cables to pass underneath the support members of base 20.

In FIG. 6, base 20, see FIGS. 1 and 2, is shown placed on a generally horizontal surface such as a stage or performing area and adjusted so that the telescoping members are surrounding a foot controller 90 of a type typically used in controlling an electric instrument such as an electric guitar. Base 20 is configured so that it surrounds the controller 90 on three sides, with central portion 22, see FIG. 2, extending along the entire front of the controller 90, first corner member 50*a* being situated at the left front corner of the controller, first inner and outer leg members 58*a* and 60*a* extending along one side of the controller, second corner member 50*b* being positioned at the right front corner of the controller, and second inner and outer leg members 58*b* and 60*b* extending along the opposite side of the controller. After the base 20 is situated as desired, screw members 74*a*–*b* and 78*a*–*b* are tightened so that the telescoping members are secured in such position. In addition, as indicated above, stand 10 can be easily angled slightly forward or to one side by adjusting the position of foot members 51*a*–*b* and 66*a*–*b*, respectively. The foot members could also be used to compensate for an unevenness or slant in the stage floor or performing area, which might occur particularly in an older performing facility. In addition, as shown in FIGS. 7 and 8, foot members 51*a* and 51*b* and 66*a* and 66*b* raise the base 20 off the stage floor a sufficient distance so that electric wires 92 operating the effects controller 90, music equipment, or other wires can be easily slipped between floor and the adjustable base members. As indicated above, the angle of the support member can also affect the ability of a musician to play his or her instrument, and can be adjusted accordingly using the foot members.

By using the telescoping base 20 of the present invention, vertical member 30, partially shown as outer telescoping portion 31 in FIG. 6, supporting microphone 40 can be situated so that it is in close proximity to the foot controller and both are in close proximity to the musician while performing with the foot controller 90 centrally located. The musician therefore no longer has to strain or lean to one side, or otherwise compensate for the disparate positions of the microphone and foot controller. In addition, such arrangement more efficiently allocates or utilizes the available space, which is important particularly in a small or cramped performing area. Such an arrangement would not be possible using prior art base systems, which typically comprise a generally circular weighted base member, because it would be impossible to centrally position such base member so that it does not interfere with the placement of the controller.

FIG. 7 is an isometric view of the stand 10 of the invention in use on a stage by a performer 100 playing an electric guitar. Vertical member 30, see FIG. 1, holds or supports a microphone 40, while base 20 surrounds a controller 90, which the performer is using to modulate or otherwise control the details of his performance. It is evident how the stand enables the performer to have both the microphone and the control stand conveniently before him. In addition, the stand is tilted forward so that there is room for the performer to play the guitar while also having the microphone close to his mouth.

FIG. 8 is an isometric view of the stand 10 of the invention with the base 20 as shown in FIG. 4 used to support a music stand 110, rather than a microphone, of a musician playing an electric guitar. It is evident how the stand of the invention facilitates positioning of the music directly in front of the musician with the controls for the instrument also readily available to the musician's feet.

Figure 9:
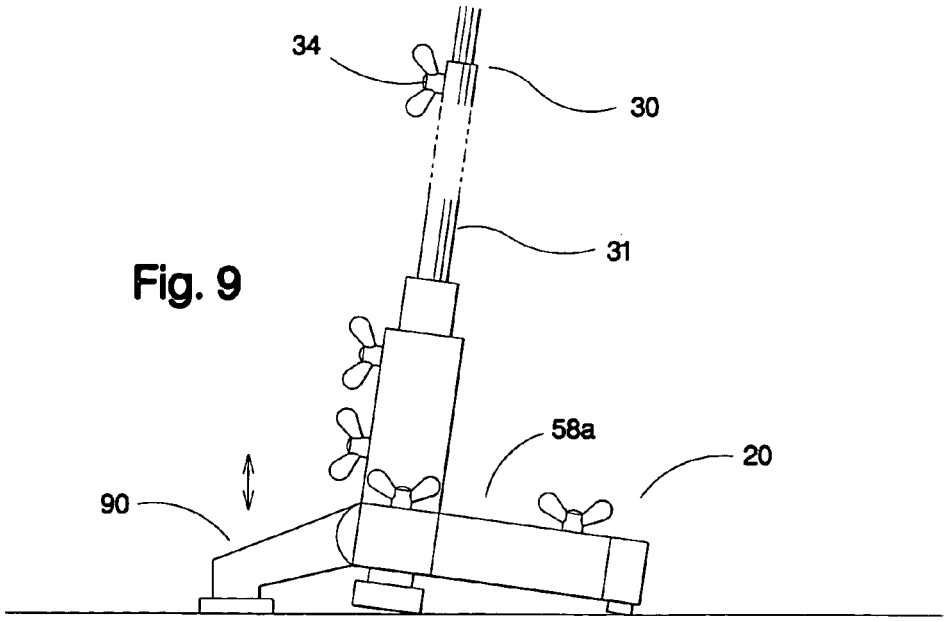
FIG. 9 is a side elevation of another slightly alternative embodiment of the invention.

Other variations to the base 20 may also be provided. For example, it is envisioned that a rubber or other vibration damping layer on base 20 may be provided in addition to rubber coated stand socket 24 to further reduce any vibrations from the equipment from interfering with the microphone. FIG. 9 is a side elevation view of another possible alternative embodiment of the invention wherein an extra stabilizing member 98 is provided extending generally opposite the direction of members 58*a* and 58*b* from the front side of stand socket 24. Stabilizing member 98 is provided to eliminate the possibility that the base 20 might tip in such direction, although by angling the base generally forward using the foot members, such possibility has already been substantially lessened. There is always a possibility of the stand being accidentally impacted by movements of the performer or by other accidental forward impact, however, and the stabilizer member 98 guards against such possibility. Member 98 is preferably vertically pivotable so that after stand 20 has been situated as desired, member 98 is pivoted downwardly until it contacts the stage surface, similar to a pivoting door stop. Suitable pivoting may be attained in several different manners, including an adjustable hinge arrangement or the like, not shown. Stand socket 24 in FIG. 9 has been slightly modified to accommodate placement of member 98. Alternatively, rather than having a single centrally located support member 98, a pair of such support members could be located on sleeves 26 and 28 or first and second corner members 50*a* and 50*b*.

FIGS. 10–15 illustrate another alternative embodiment of the stand 110 having a slightly different base arrangement but wherein the base is also telescopingly adjustable so that it can be accommodated to or placed or situated around other equipment in a crowded stage area. In general, in such alternative embodiment of the base, instead of the base being formed from heavy tubular or cast sections of whatever composition, such base is formed from lighter plastic or aluminum sections, which sections may be square or rectangular or tubular in cross section. The heavy tubular or cast construction tends to be fairly steady upon a performing stage or platform because of its substantialness, but heavier and more difficult to transport. The alternative base is formed from lighter, thinner tubular sections that can be easily folded together and transported, but may be less steady and more easily toppled by accidental impact without being unduly unstable. The same principle of having the supporting arm extending upwardly at an angle from the base and having legs or base sections extended to the side and then rearwardly at the ends in the same direction as the inclination of the microphone or other support and having a space in the center into which foot control equipment may be centered is adhered to and the base sections are adjustable in two directions, i.e. forward and back and to the side by preferably a telescoping construction. Since the tubular sections are fairly light gauge, the device, while still fairly steady, is lighter and easy to transport. The central section may also be easily disassembled, if desired, for transportation.

Figure 12:
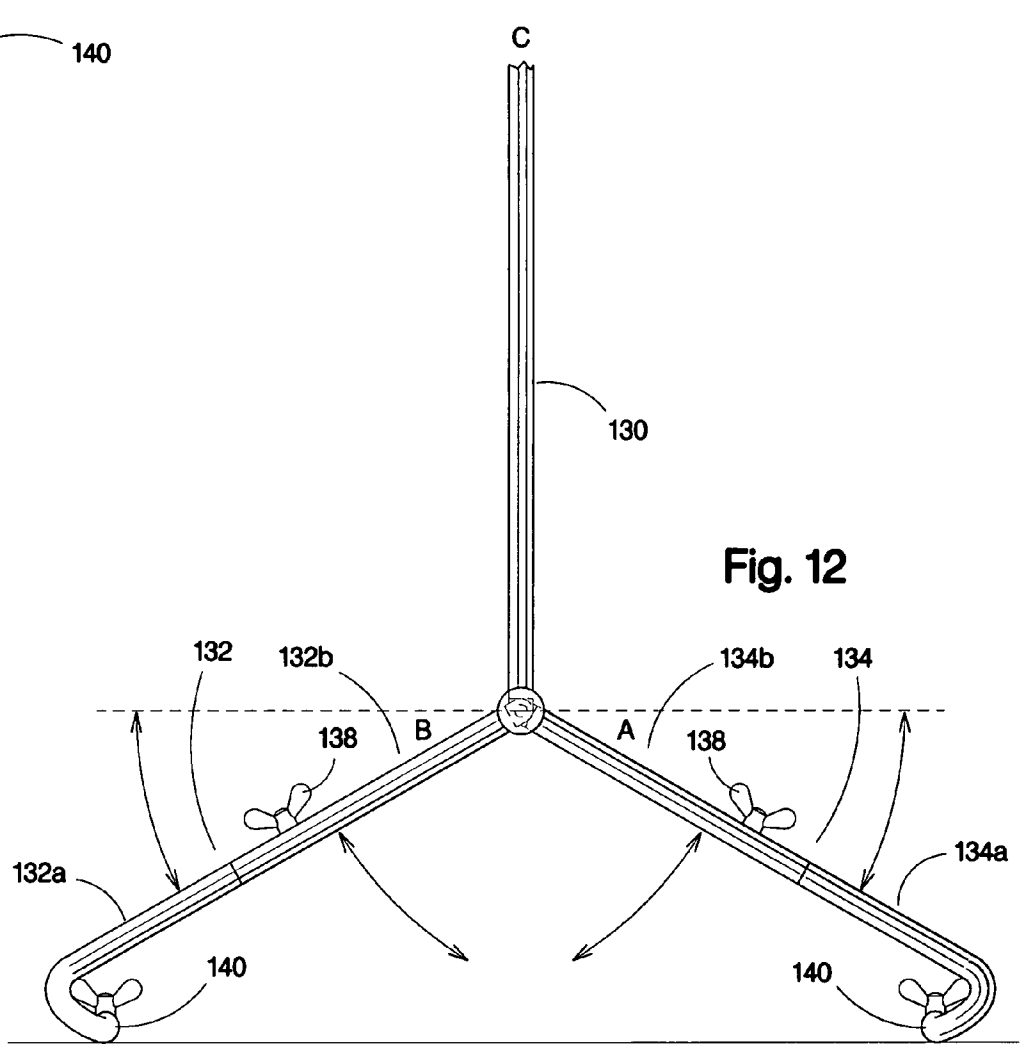
FIG. 12 is a front view of the stand shown in FIGS. 10 and 11 with the leg members slightly pivoted away from a support surface.
Figure 10:
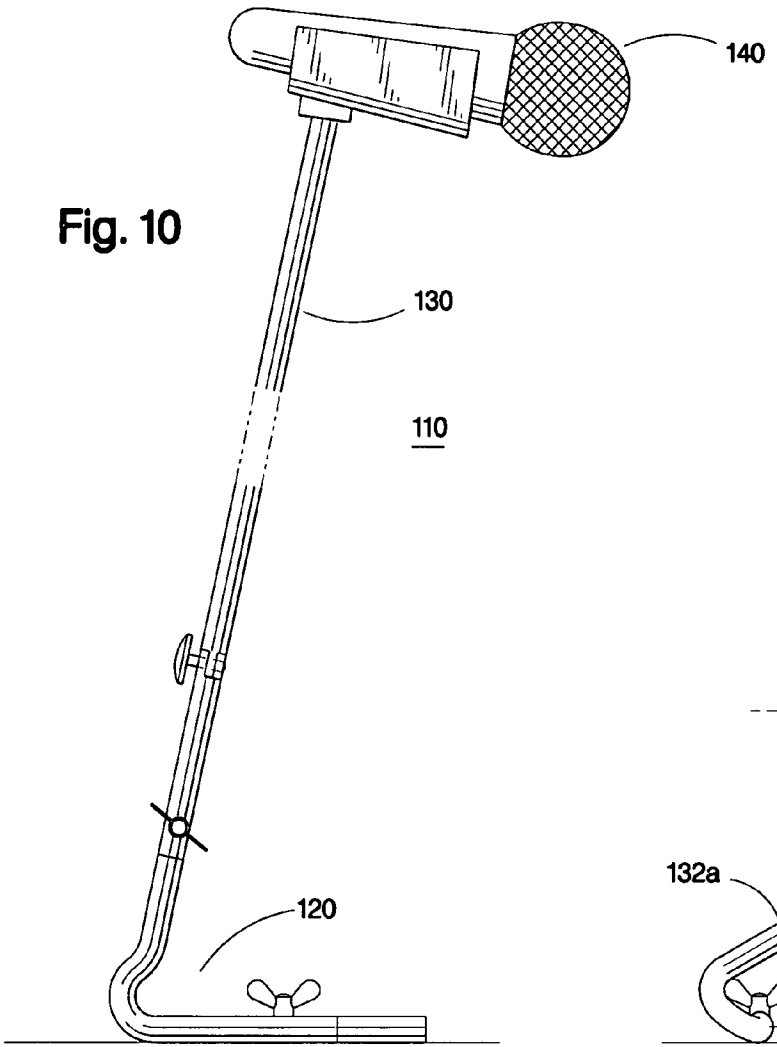
FIG. 10 is a side elevation view of another alternative embodiment of the invention.
Figure 13:
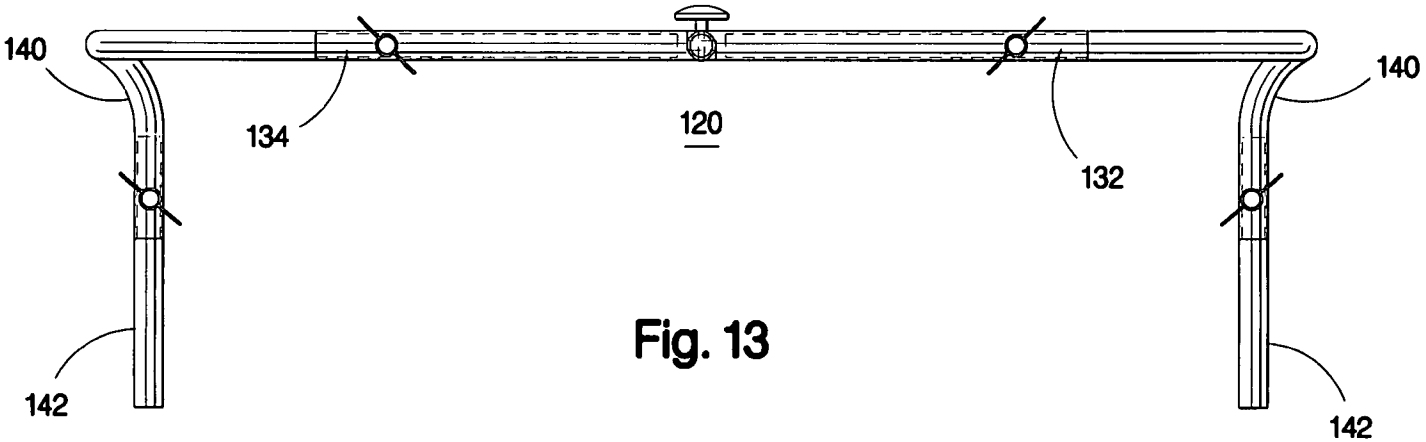
FIG. 13 is a top view of the base of the stand shown in FIG. 10.
Figure 11:
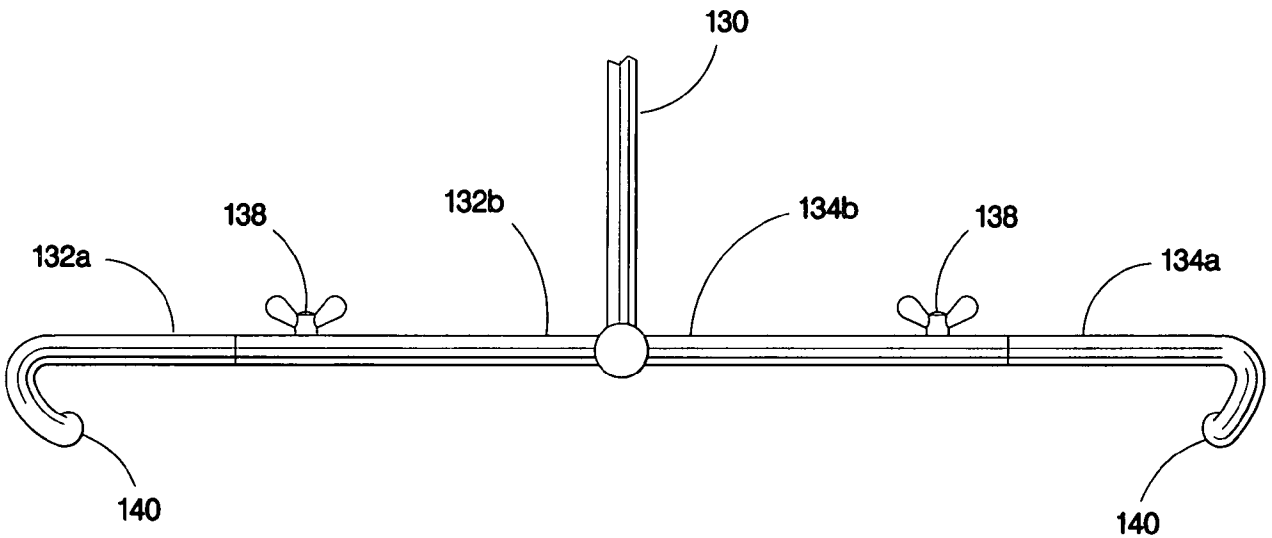
FIG. 11 is a rear view of the stand shown in FIG. 10, as it would normally be viewed from the audience side.

FIG. 10 is a side view of stand 110 which is comprised of base 120, adjustable vertically extending support member 130, and any suitable clip or holder for microphone 140. As shown in FIGS. 11 and 12, base 120 includes two outwardly extending leg members 132 and 134. Preferably, each leg member 132 and 134 is comprised of inner and outer telescoping sections 132*a*–*b* and 134*a*–*b*, which are secured or held together by threaded jam members 138. In addition, leg members 132 and 134 preferably have downwardly curved outer ends which form feet 140. Leg members 132 and 134 are generally pivotable from a position shown in FIG. 11, where the legs are situated so that they are generally horizontal to the floor or stage surface while support member 130 is perpendicular to such leg members, to a position such as shown in FIG. 12, where the legs have been pivoted so that they are angled in relation to the floor, as indicated by the arrows. As is visible in FIG. 13, which is a top view of the base 120, feet 140 are generally angled downwardly and then extend at right angles from leg members 132 and 134 so that a U-shaped arrangement is again formed. Extending outwardly from the ends of feet 140 are telescoping side or foot members 142, which are adjustable in the same manner as in the previously described embodiments.

Figure 14:
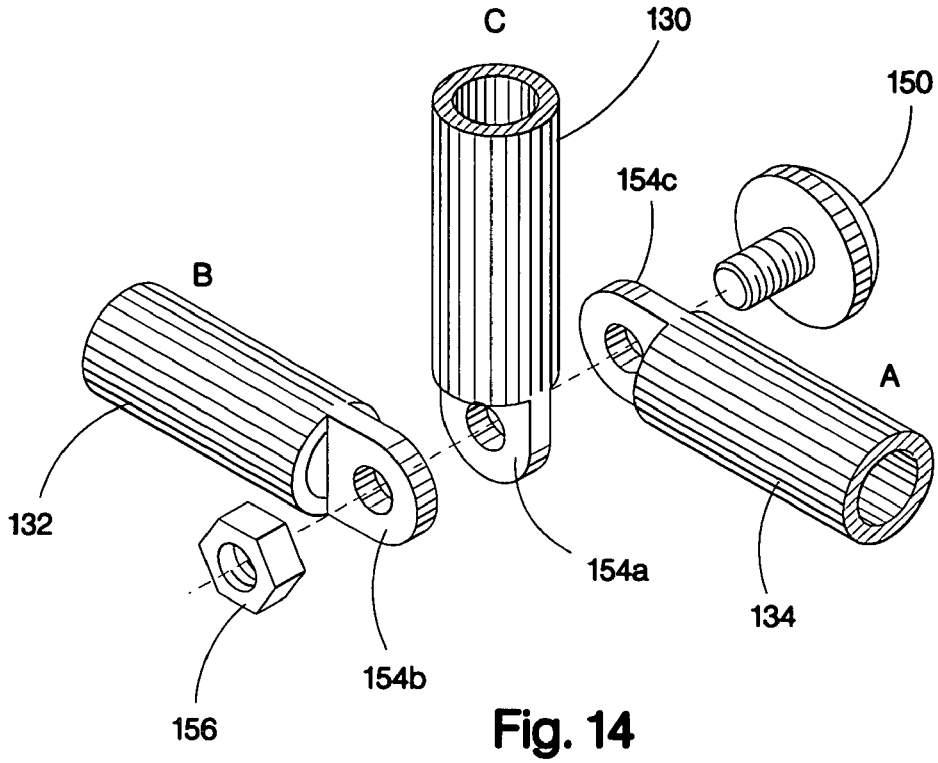
FIG. 14 is a close-up isometric view of the arrangement for attachment of the leg members to the support member in FIG. 10 shown disconnected or disassembled for clarity.
Figure 15:
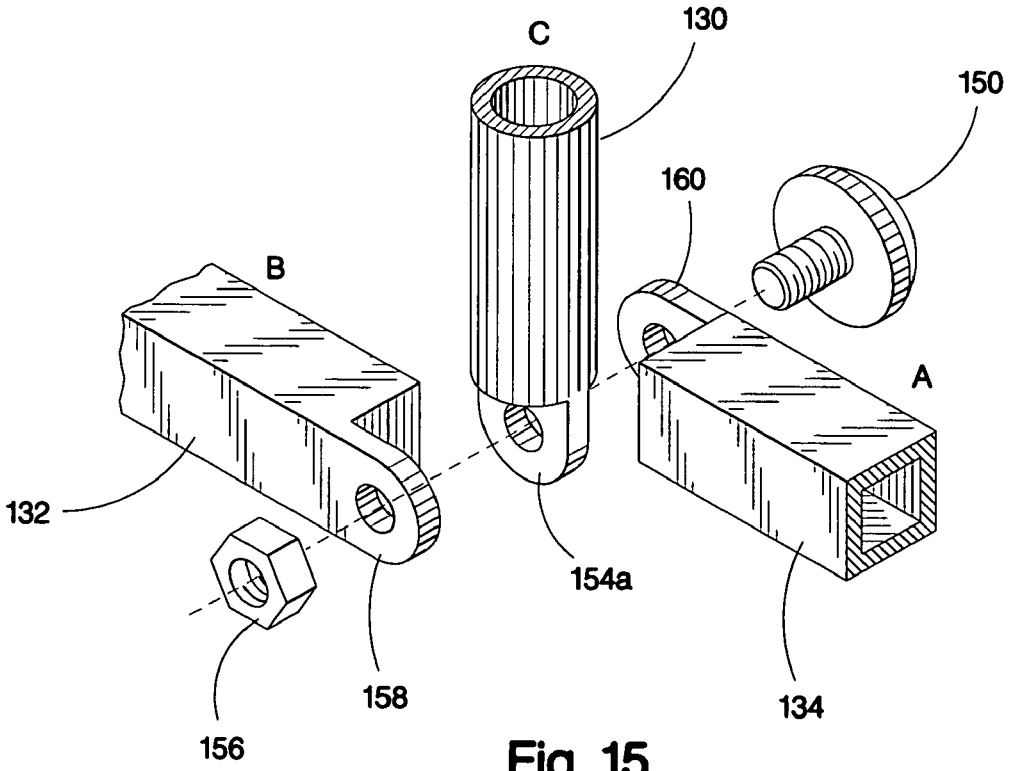
FIG. 15 illustrates a slightly alternative arrangement for attachment of the leg members to the microphone support member also shown disconnected or disassembled for clarity.

FIGS. 14 and 15 show two slightly different arrangements for securing leg members 132 and 134 to microphone support member 130. In FIG. 14, apertures 154*a*, 154*b*, and 154*c* are positioned on or near the ends of support member 130 and leg members 132 and 134, respectively. Bolt 150 may be passed through each of such apertures and secured by nut 156 so that leg members are pivotable about the same point. In FIG. 15, leg members 132 and 134 have upper and lower generally horizontal offset portions 158 and 160 to which apertured end 154*a* of support member 130 is pivotably secured. Either arrangement is an acceptable means for enabling the angle of leg members 132 and 134 to be easily adjusted. It will be understood that the intersecting sections containing fastening orifices will be oriented so that when connected together by suitable fastenings the base sections will extend to the side while the microphone or apparatus support section will extend upwardly with a slant in the same direction as the end of the legs of the base. As shown in FIG. 10, for example, support member 130 is preferably angled slightly forwardly as in the previous embodiments. In addition, FIG. 11 shows that sufficient room is provided between the floor or stage area and leg members 132 and 134 for wiring or cables to be strung, making setup of electronic equipment even easier. Each of the embodiments shown accomplishes the same purpose of providing sufficient space directly in front of a performer for placement of equipment in addition to a microphone stand, thereby improving the ability of a musician to give an effective and enjoyable performance.

The inventor has now as the result of further development work realized that the invention has applicability to other uses by a musical artist than use merely as a microphone or music stand, the base of which, by surrounding a foot control apparatus, can provide better use of stage space. Stage space is of tremendous importance where such space is not particularly great. It has now become evident that the same principle according to which the microphone stand base has been constructed can be applied as well to effective use of the stand of the invention as a stand for holding instruments such as spare, or alternative, guitars or other stringed instruments, or, indeed, any instrument at all, plus, where desired smaller electronic control apparatus or other elements are used support of such equipment and further that the U-shaped base will fit very neatly about relatively large heavy equipment such as, for example, amplifier equipment which can fit nicely into the broadly U-shaped space within the open side of the adjustable and foldable base. For example, a musical artist may wish to use the stand as a microphone stand with the base compactly surrounding a foot control of various types, plus use another more or less identical stand having its base surrounding a loudspeaker plus use various trays or holders attached to a sturdy upstanding rod or a post extending upwardly from the base, whereby electronic control elements of the foot controller may be supported upon a rack clamped to the supporting rod or post. A loudspeaker may be placed in the space defined by the legs of the base, with the further support at a quick accessibility level upon the post of a spare instrument such as a guitar resting upon brackets clamped at a convenient height upon the support rod. The inventor has also designed special strengthened brackets for use on his support rods or posts connected to his base plus a smaller folded base attained by use of folding telescoping end pieces rather than fixed telescoping end pieces of earlier embodiments thereby adding increased convenience for transportation and/or storage. The inventor has also created a combined microphone stand and front balance leg for his adjustable musician's stand. Such further improvements and adaptations are shown in the following described drawing figures.

Figure 16:
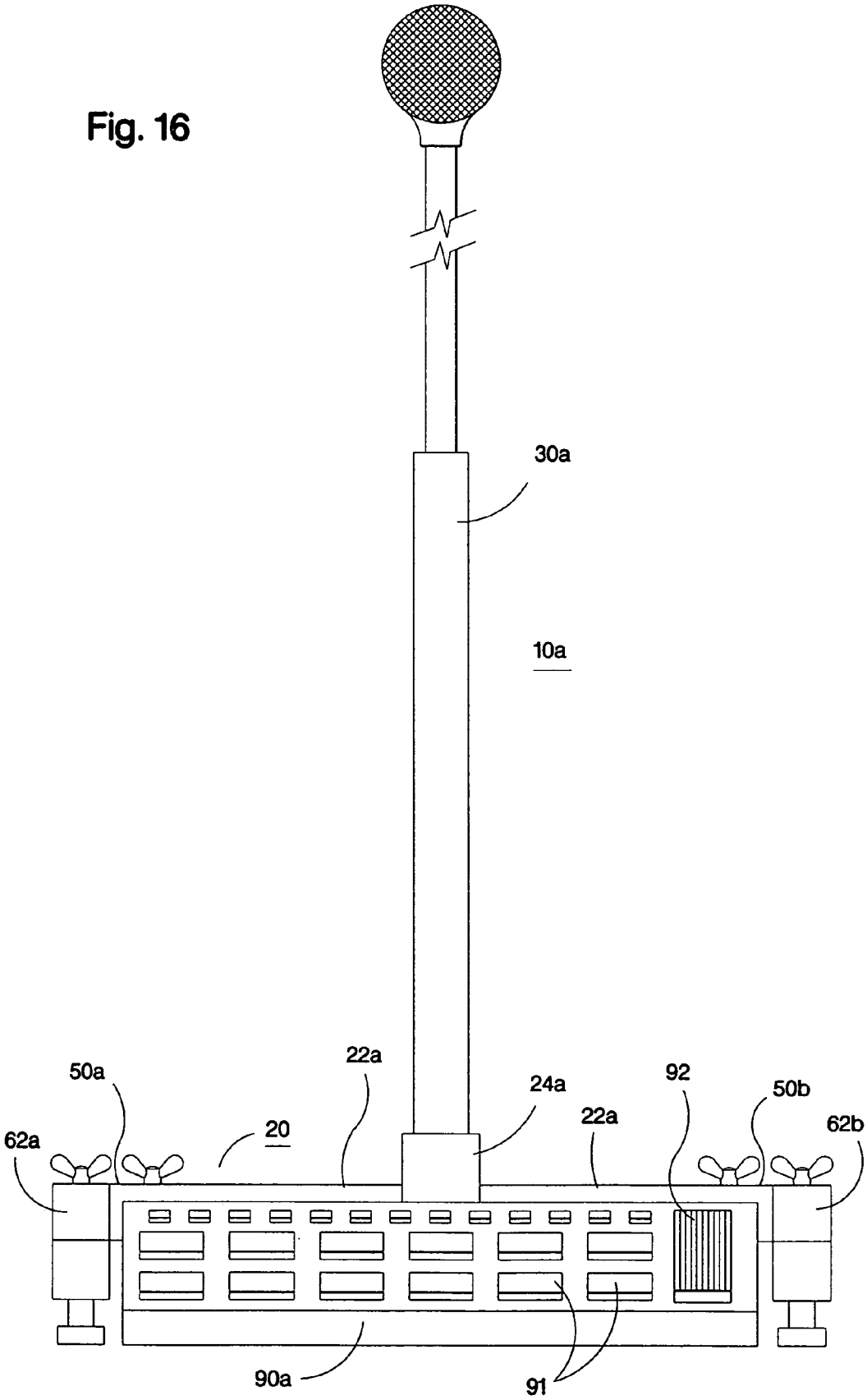
FIG. 16 illustrates a further embodiment of the invention incorporating a wider U-shaped stand in which a wider and more sophisticated foot controller may be accommodated directly in front of a musician on a stage or the like and accommodating a square microphone support post.

FIG. 16 is an isometric view of an expanded foot pedal type control for controlling the sound and sound effects of a loudspeaker and sound effects system, surrounded by a longitudinally and laterally expandable base in accordance with the inventors principal embodiment shown in FIGS. 1 through 9, the embodiment of the microphone stand 10*a* shown in FIG. 16, however, being significantly wider appropriate to the wider foot control. The foot control 90*a* has a series of foot pedals or buttons 91 which can be pressed to implement various electronic and sound modulation effects as known in the art, plus a longer rocking pedal 92 which will usually control the loudness of the system dependent upon how far the pedal is depressed as also well known in the art. The pedal 92 is designed to have a fair range of movement so that precise control of volume can be effected. The base 20 has fairly long tubular sections 22*a* extending from the central holder or socket 24*a* or across the central portion of the base 20 under the microphone socket 24*a*. A pair of two legged L-shaped end pieces 50*a* and 50*b* as in FIG. 2 complete the end of the base 20 and telescoping legs 62*a* and 62*b* extend from these. A microphone stand or post 30*a* extends upwardly from the socket 24*a*. FIG. 16, therefore, illustrates a stand basically similar to the stand shown in FIGS. 1 through 9 extended about a wider foot control than shown in FIGS. 6 to 8. Such foot control may have its state of the art electronics either in the foot control itself or housed in a second controller which can be supported away from the floor upon a stand or table or the like where it is better separated from shocks and damage due to rough treatment of the foot controller by the instrumentalist or performer.

Figure 17:
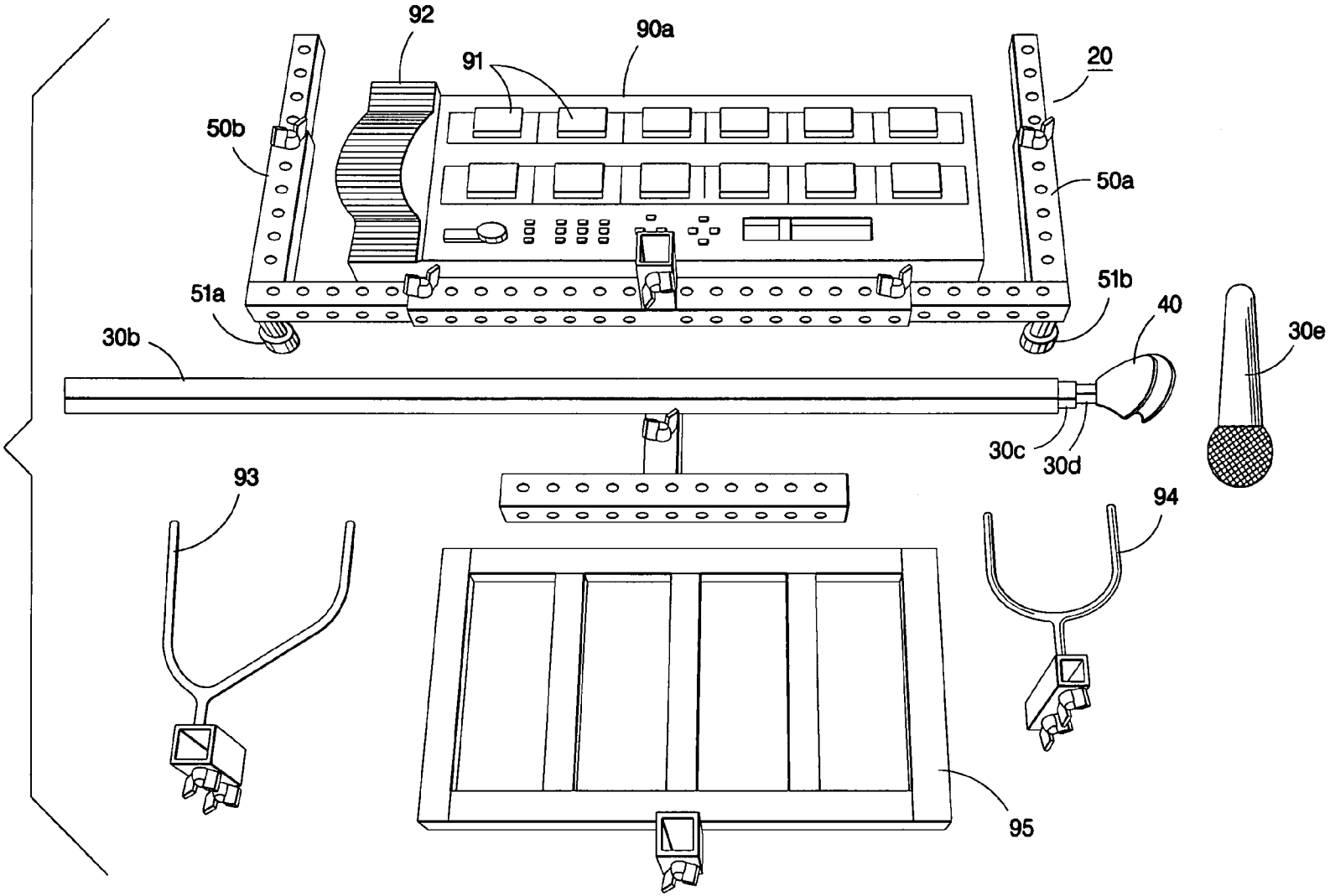
FIG. 17 shows the microphone stand shown in FIG. 16 disassembled and laid out on a surface ready to be assembled for use either in the configuration shown in FIG. 16 or with an alternative arrangement or configuration as a backup stand as shown in FIG. 18 in which a loudspeaker may be accommodated in the central section and several forms of racks may be mounted on the support post.

FIG. 17 shows in isometric projection from the front above the parts of the stand 10*a* laid out upon a surface after disassembly with the base 20 still extended, for illustration, about the foot control 90*a*. In addition, several innovations are shown which are not shown in FIG. 16 including a sturdy square tubular microphone stand 30*b* which accommodates a telescoping central square tubular member 30*c* for expansibility with a cylindrical microphone support fitting 30*d* attached to the top with a microphone 40 at the end. Such square tubular support 30*b*, as will be explained, may do double duty as part of a support stand when used alternatively to support other elements of a musician's equipment including electronic control means plus extra instruments and the like. Also shown in FIG. 17 are two instrument brackets 93 and 94 which can be fitted over the square tubular member 30*b* and clamped with screw clamps, plus a tray support 95 also provided with a square tubular clamp which fits over the support rod 30*b* and can be clamped by wing type threaded clamping means at any desired level. The small adjustable screw-type feet 51*a* and 51*b* can be seen on the front (as used for support of a microphone) can be seen in FIG. 17 on the base 20 at the bottoms of the two end pieces 50*a* and 50*b*. The further brackets 93 and 94 plus the tray support 95 may be used attached or clamped to the support rod 30*b* when used as a utility or spare instrument support. See FIGS. 18 and 19.

Figure 18:
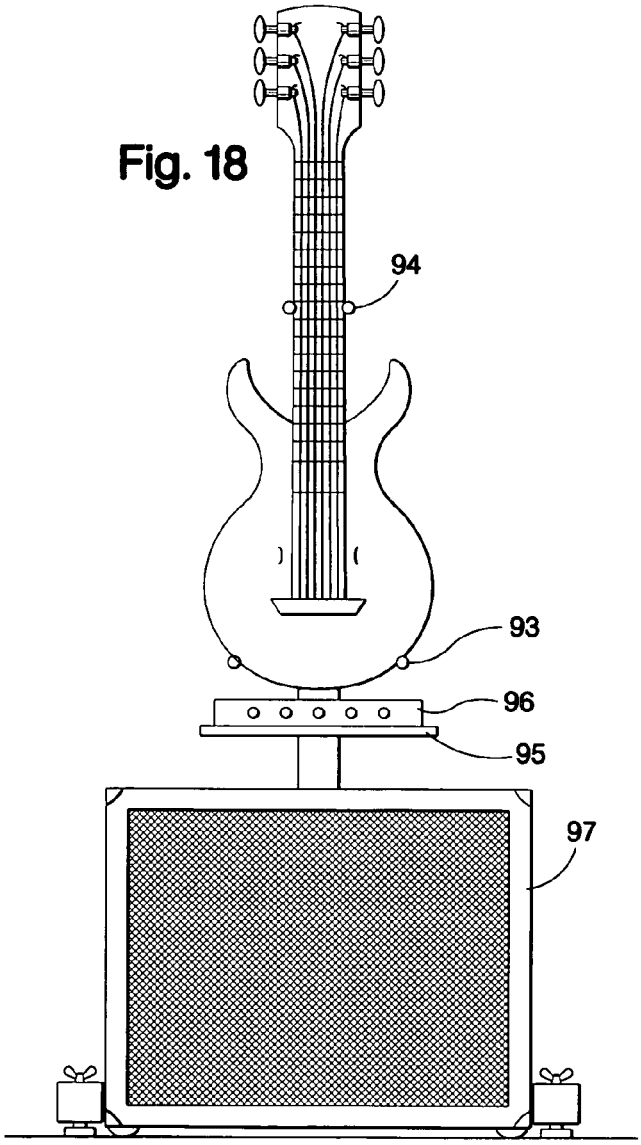
FIG. 18 shows the alternative configuration into which the equipment of FIG. 17 may be formed together with a loudspeaker that fits between the telescoping leg portions and a guitar supported on the rack.
Figure 19:
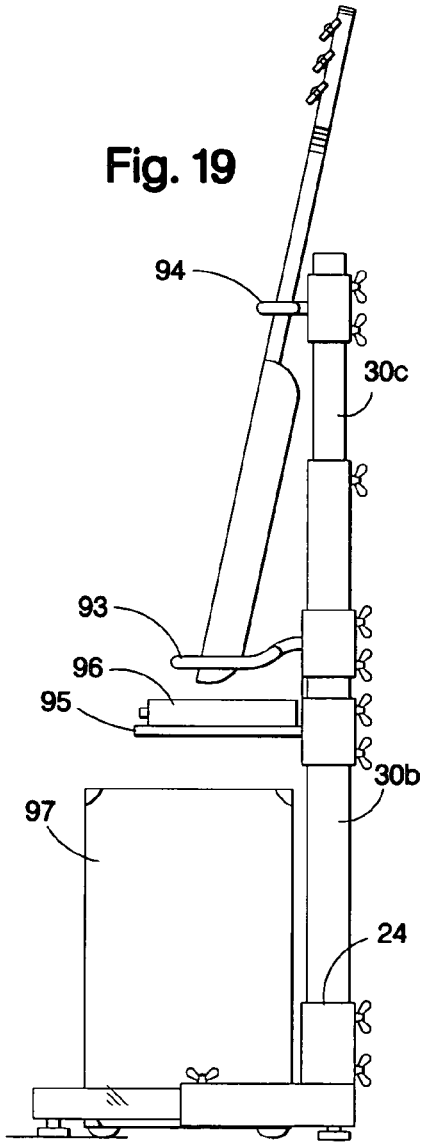
FIG. 19 is a side view of the stand configuration shown in FIG. 18.

FIG. 18 is a front elevation and FIG. 19 is a side elevation of the base and support of the invention when used in an alternative fashion, for example, in FIGS. 18 and 19, as a support for a spare instrument readily and almost instantaneously available to an instrumentalist from a rack in back of such instrumentalist. Racks or brackets 93 and 94 clamped onto the support rod 30*b* are shown as well as tray-type support 95 also clamped on the support rod 30*b*. The tray-type support 95 is shown with the electronic control case 96 for the foot control unit 90*a* supported upon it. It will be understood, however, that the tray 95 could be used to support anything else desired, including even the lower end of one of the instruments. Ordinarily, however, the bracket 93 will be used to support the lower end of an instrument and the bracket 94 will be used to hold the upper end of the instrument. It may be readily noted in FIG. 19 that each of the brackets 93, 94 and tray 95 are provided with two threaded interlocks on their slide bases encompassing the support rod 30*b*. Also the socket 24, as in FIGS. 4 and 5, is provided with dual screw clamping means. Under the tray bracket 95 supporting the electronic control 96 and between the legs 58*a* and 58*b* is a large amplifier 97 through which the musician's program and musical accompaniment may be broadcast. The slide portion of the brackets 93 and 94 and tray 95 may have larger or smaller open slide portions depending on which portion of the support post they are to be clamped upon.

Figure 20:
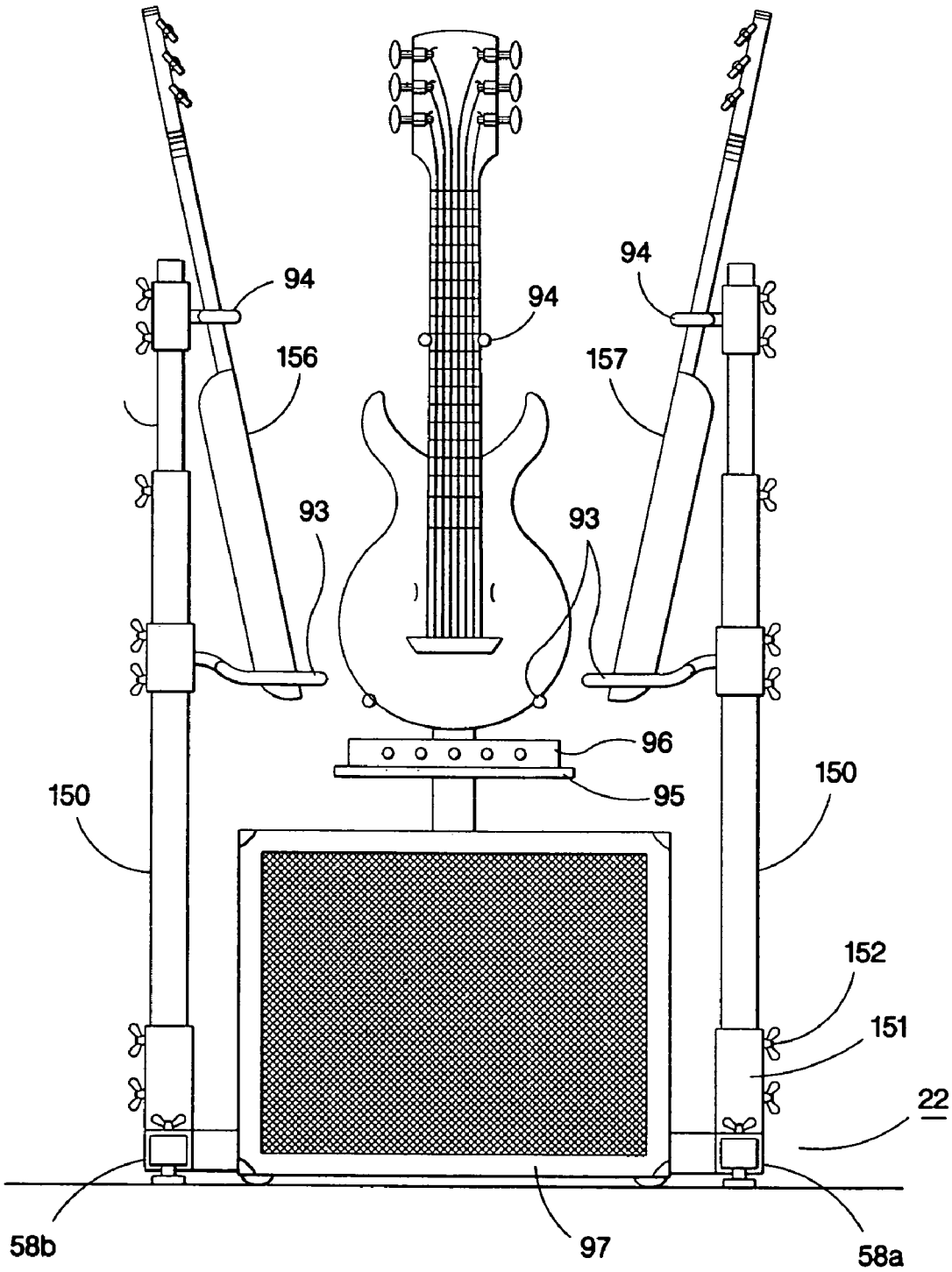
FIG. 20 is an elevation of a modification of the arrangement shown in FIG. 19 with the addition of two additional side posts for the support within easy grasp of additional items such as two additional guitars as shown.

FIG. 20 is an elevation of a further elaboration of the stand apparatus shown in FIG. 18 in which not only is there a broad U-shaped base 22 surrounding an amplifier 97 with an electronic controller 96 accommodated on a tray 95 above it clamped to a square or rectangular post to which brackets 93 and 94 are also attached or adjustably clamped, but there are in addition two further support posts 150 secured to the outer legs 58*a* and 58*b*, preferably in a manner to be described. These two posts 150 are mounted in sockets 151 extending upwardly from the legs 58*a* and 58*b* and as shown have double threaded clamp means 152 to clamp the posts 150 securely in them in a manner similar to that shown in FIGS. 1, 4, 5 and 19. These sockets 151 may be attached to the legs 58*a* and 58*b* in several manners, the easiest way being shown in FIG. 21 described below.

Figure 21:
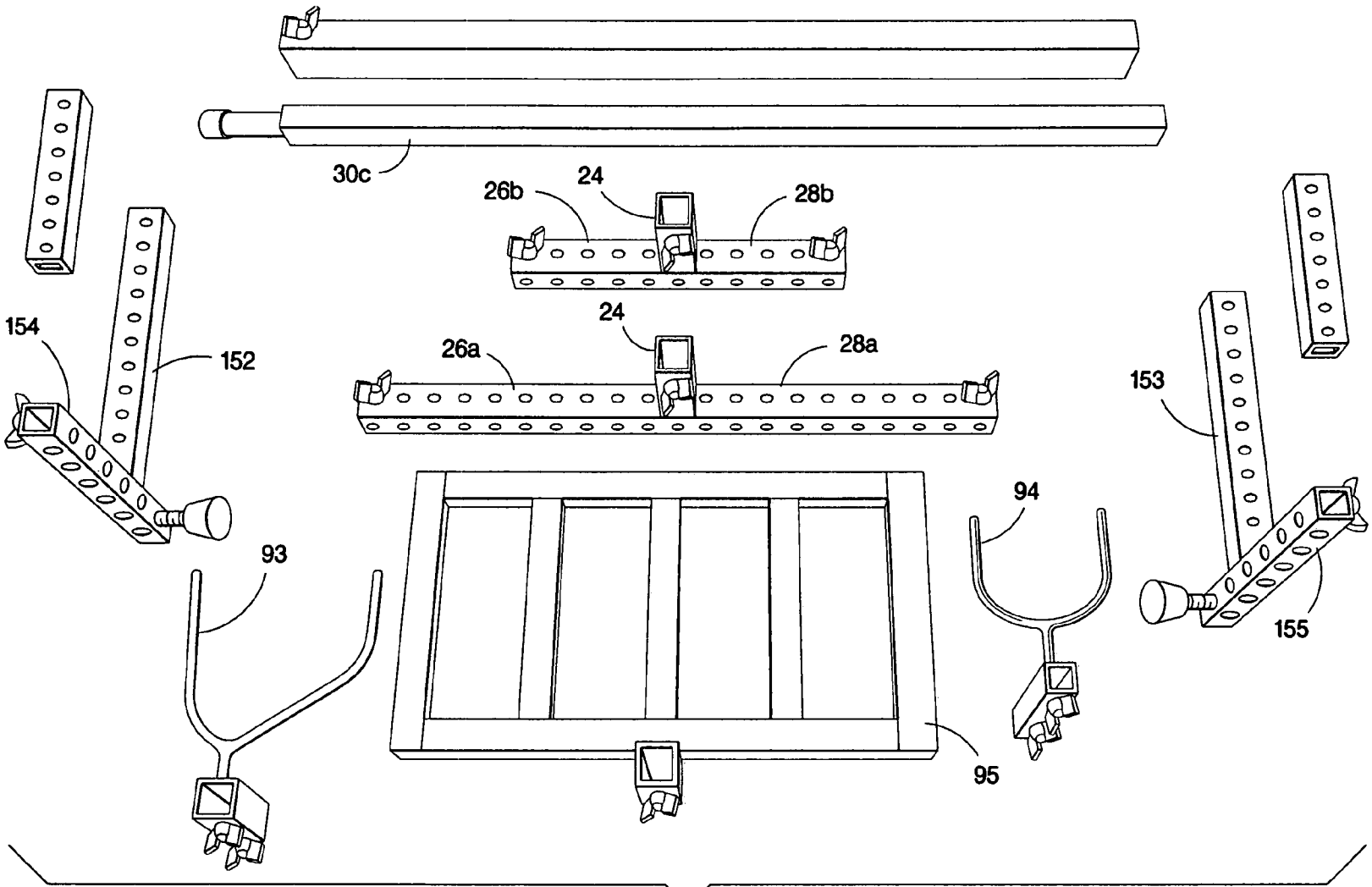
FIG. 21 is a view of the parts of the apparatus shown in FIG. 20 laid out ready to be assembled including side brackets to support the telescoping side posts.
Figure 29:
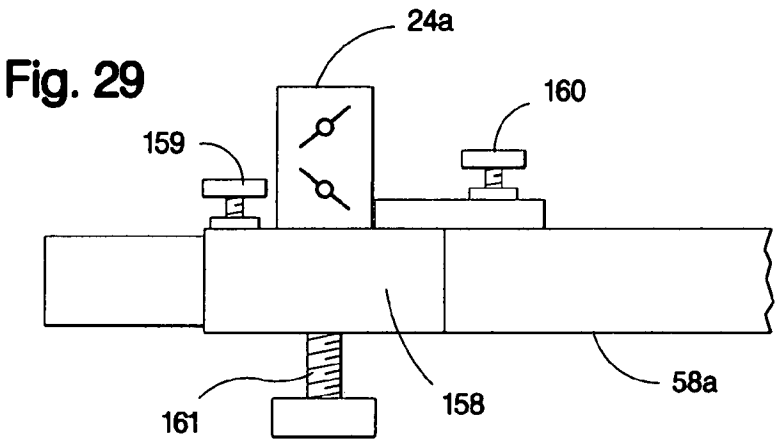
FIG. 29 is a side view of the bracket of FIG. 28 installed on an end leg of the stand base.

FIG. 21 shows the various pieces of the stand shown in FIG. 20 laid out after or before assembly except for the end pieces or corner pieces 50*a* and 50*b*. There are shown two alternative central pieces or front legs 26*a* and 28*a* and 26*b* and 28*b* each with a central socket 24 for receipt of the central post 30*b* or 30*c*. To these would be added a corner piece 50*a* and 50*b*, not shown, arranged with square tubing to receive the ends of the base legs 26 and 28 plus the end sections or legs 62*a* and 62*b*. The section 152 and 153 may be substituted for these end legs. Sections 152 and 153 both have an upstanding socket 154 and 155 which may accommodate posts 150 together with their brackets 93 and 94 for support of musical instruments such as guitars and the like, 156 and 157. (See FIG. 20). A further arrangement for attaching the posts 150 is shown in FIGS. 29 and 30.

Figure 22:
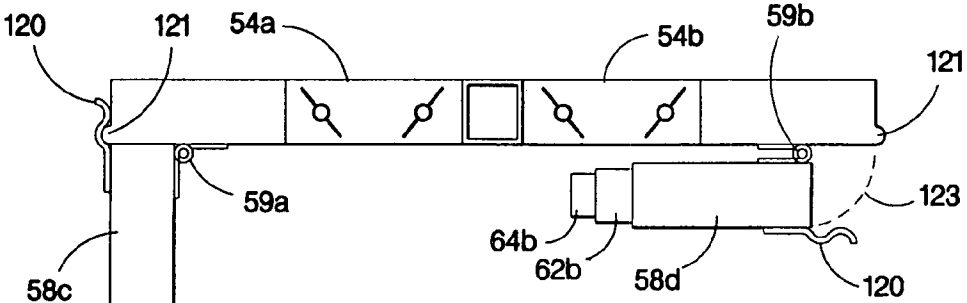
FIG. 22 is a plain view of an improved end construction for the base of the stand in which the extensible sides of the U-section may fold parallel to the main or front piece.
Figure 22A:
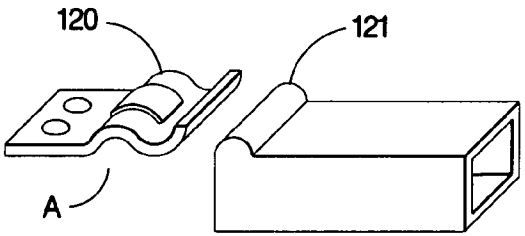
FIG. 22A is an enlarged view of the locking action of the catch which holds the pivoting end pieces in the folded position.

FIG. 22 discloses a further improvement of the end legs 58*a* and 58*b* shown in previous figures. In this improved arrangement the end section, instead of being a rigid fitting 50*a* and 50*b* shown in previous figures with sleeves for telescopic connection to other sleeve or leg sections such end piece or leg sections, is formed from a section of square tubing 58*c* and 58*d* hinged to the sliding tubing of the sections 54*a* and 54*b* at hinges 59*a* and 59*b*. The telescoping ends 62*a* and 62*b* shown in previous figures continue to extend from the sections 58*c* and 58*d*. A spring catch or lock 120 engages with a detent 121 when the sections 58*c* and 58*d* are swung out perpendicular to the sections 54*a* and 54*b* when in use. The hinged sections may be swung back, however, into storage position as indicated by dashed line 123 at which time they lie compactly parallel to the sections 54*a* and 54*b* as shown in FIG. 22 on the right of the drawing, creating a more compact package for storage. FIG. 22A is an enlarged view of the spring catch 120 and the detent 121 on the end of telescoping sections 54*a* and 54*b*.

Figure 24:
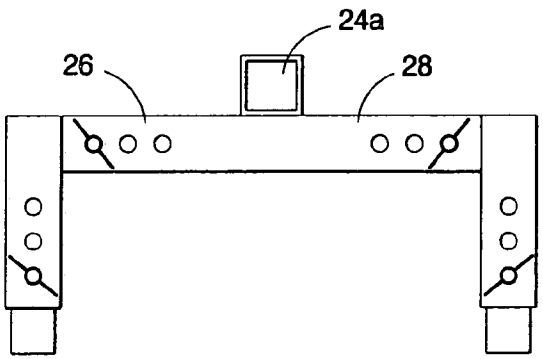
FIG. 24 is a plain view of the base of the invention shown in FIG. 23 without the center post or microphone post.
Figure 23:
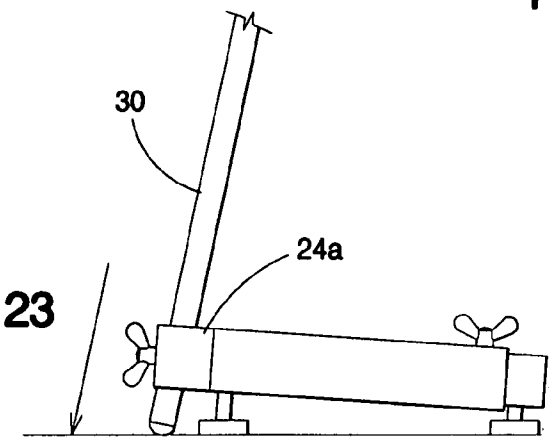
FIG. 23 is a side elevation of a portion of the base of the invention showing an alternative arrangement in which a microphone stand may be attached to the side of the base and extended to the underlying surface to serve as an additional brace to prevent forward instability of the stand.

The present inventor has also realized that the lower portion of center or support post 30 of the stand of the invention may be substituted for the forward leg 90 shown in FIG. 9 for balance. This is accomplished as shown in FIGS. 23 and 24 where it is shown that the socket 24*a* can be attached to the base 20 on the side of the front cross members 26 and 28 and be provided with an open bottom so that the post 30 itself can be extended downwardly to contact the stage as a further balancing leg as well as a support post. In this arrangement the socket 24*a* can be provided with a single or double screw clamping arrangement, particularly, since considerable of its weight will be supported by the performing stage surface itself.

Figure 25:
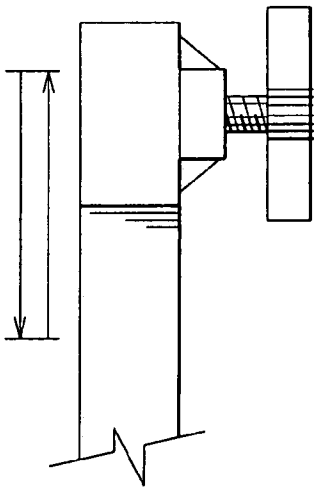
FIG. 25 is a side view of a typical screw threaded interconnection on adjustable length sections.
Figure 26:
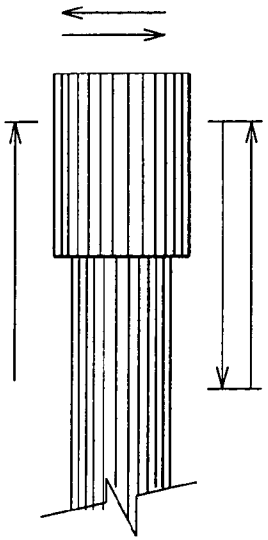
FIG. 26 is a side view of a typical twist type friction lock between sliding post parts which is used on most telescoping microphone stands and can be adopted for use in the present invention when the interconnecting slide members are cylindrical in shape.

The telescoping members of the stand of the invention can in each case be interlocked in operating position either by a screw-threaded clamping arrangement particularly as shown as a generality in FIG. 25 for either rectangular or cylindrical members or by a common twist friction lock when used on cylindrical members. Such twist friction locks are very common, for example, on microphone stands. See FIGS. 25 and 26 where FIG. 25 indicates diagrammatically the use of a screw-type interlock to lock two sliding or telescoping members together, and FIG. 26 illustrates diagrammatically an equivalent twist friction lock for the same purpose, but usually confined to use on a cylindrical member. The arrows indicate the sliding relationship between the members when unlocked as well as the twisting movement of the lock section.

Figure 27:
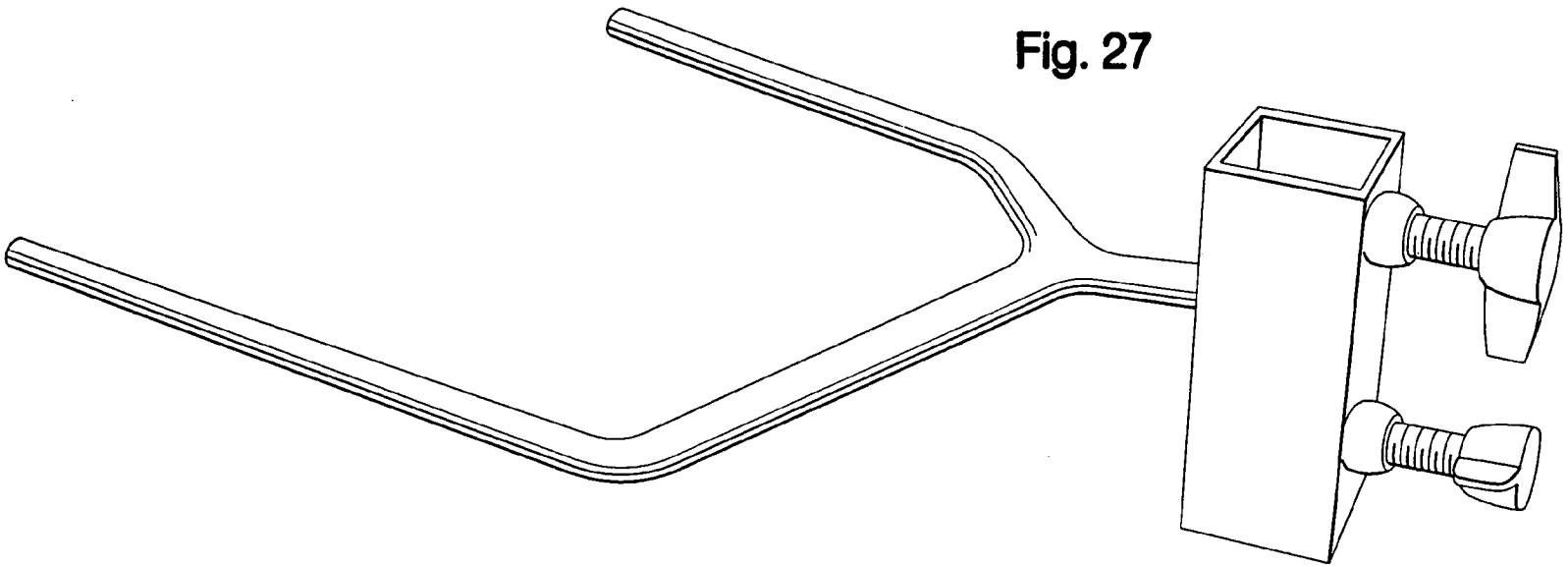
FIG. 27 is an isometric view of a double screw threaded interlock sliding holder for use on the vertical supports or posts of the invention where additional security in the interlock with the vertical support is desirable or required.
Figure 28:
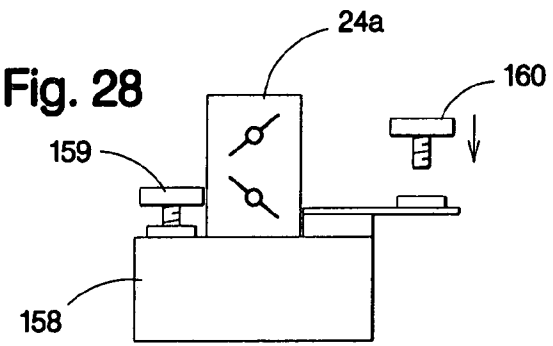
FIG. 28 is a side view of an alternative bracket for support of the side posts shown in FIG. 20.

FIG. 27 is an isometric view of one of the applicant's sliding brackets with double screw interlock means. If the post upon which it was to be mounted was cylindrical the collar or sleeve would be preferably cylindrical as well, but the double screw threaded interlock would remain basically the same.

FIG. 29 shows a connector 158 having a lower tubular section which may slide over one of the end legs 58*a* or 58*b* and interlock therewith by means of threaded members 159 and 160. The end post 150 may then be inserted into the socket 24*a*. A screw-threaded foot 161 may be screwed into the bottom of the fitting or connector 158. FIG. 29 shows the fitting 158 connected to or between the legs 50*a* and 60*a* and/or 50*b* and 60*b*.

The inventors modification of the basic stand of the invention so it can by the use of various additional accessories plus the use of improved refinements such as folding end legs on the base, arrangement of the upper socket on the front side of the base so it can serve double duty as a balancing leg and use of double screw locked brackets to hold accessory trays and brackets to the supporting brackets has substantially increased the utility of the invention.

In addition to the improvements and modifications described above, through trial and error the present inventor has now also made several further improvements to the present invention that increase its overall functionality, particularly when used for holding heavy equipment such as an amplifier, and providing a more compact arrangement for storage and carrying of the stand.

FIGS. 30 and 31 are top and side views of another preferred embodiment of the adjustable stand base 10*c* of the invention. Such embodiment is similar to the embodiments shown in FIGS. 1–9 above, except in the present embodiment the adjustable foot members 51*a* and 51*b* in FIGS. 4 and 5, rather than being attached to the bottom sides of corner pieces 56*a* and 56*b* of corner members 50*a* and 50*b*, are attached in housings on the front side of such corner pieces. More particularly, in FIGS. 30 and 31, threaded housings 306 and 307 are shown permanently secured such as by welding to the front side walls of corner pieces 56*a* and 56*b*, respectively. Housings 306 and 307 may be in the form of long threaded nut members into which foot members 51*a* and 51*b* are threadably movable to facilitate adjustment of the height or angle of stand. Similarly, foot members 66*a* and 66*b*, shown in FIG. 6 attached to the underside of end members 64*a* and 64*b* of telescoping members 60*a* and 60*b*, have been moved to the rear side surface of such members

64*a* and 64*b*, where threaded housings 308 and 309, which may also be long threaded nut members, are secured preferably by welding.

Several advantages result from positioning foot members 51*a* and 51*b* in housings on the front side of corner pieces 56*a* and 56*b*, and positioning foot members 66*a* and 66*b* in housings on the rear surface of members 64*a* and 64*b*. First, such arrangement gives the stand additional support or stability by widening its base, which makes the stand much less likely to tip in either a forward or rearward direction if it is bumped during a performance, which occurs rather frequently. In addition, as shown in the FIGS. below, such arrangement also facilitates folding or storing of the stand in a substantially more compact configuration for transport to and from a performance or storage when it is not in use. To allow for such compact storage arrangement, another modification must be made from the previously described embodiments in that the sides or ends 310 and 311 of corner pieces 56*a* and 56*b* of corner members 50*a* and 50*b* are cut away or removed, creating opening 312 in such members. With that the ends 310 and 311 of corner pieces 56*a* and 56*b* now being open, and since the inner ends of telescoping members 54*a* and 54*b* of tubular corner members 50*a* and 50*b* are also open, a through-aperture is created in which telescoping microphone support 30 may be slipped and secured for storage.

The method of storing stand 10*c* compactly will now be described with particular reference to FIG. 32. First, as shown by the dotted line 315 in FIG. 31, when it is desired to store stand 10*c*, the telescoping ends 54*a* and 54*b* (see FIG. 3) of corner members 50*a* and 50*b* are removed from first and second outer sleeves 26 and 28 of central portion 22, respectively, rotated ninety degrees in a counterclockwise direction, and then reinserted into such outer sleeves. Such arrangement is preferred because as a result, as shown in FIG. 32, the upwardly protruding stand socket 24 and outwardly extending sleeves 58*a* and 58*b* of corner members 50*a* and 50*b* are now in the same plane, which results in a substantially more compact storage arrangement. Next, telescoping microphone support member 30 having inner and outer telescoping sections is moved to an unextended position secured, and then is pushed in aperture 312 in one of the sides or ends 310 or 311 of corner pieces 56*a* and 56*b* until its end extends out the other side or end 310 or 311, as shown in FIG. 32. Once inserted, threaded jam-type screw members 74*a* and 74*b* may be tightened to secure corner members 50*a* and 50*b* and microphone support member 30 in such position. To facilitate transport or carrying of the stand 10*c*, an adjustable carrying or shoulder strap 320 is provided. Strap 320 includes a flexible strap section 321, and a pair of metal clip sections 322 and 323 on the ends of said strap section 321. Each metal clip section 322 and 323 has a threaded screw 324 and 325 connected thereto which can be inserted and secured in the top ends of threaded housings 306 and 307, respectively. Thus, as is evident from FIG. 34, the stand 10*c* is now in a complete storage configuration and may be easily carried to and from a performance by shoulder strap 320. It should be evident that stand 10*c* when stored in such manner takes up much less room and is significantly easier to carry and store than typical prior art microphone stands, while setup is still quick and easy.

FIGS. 33–41 illustrate another preferred embodiment of the invention that is most similar to the arrangement shown in FIGS. 17–19 above, but with further modifications made to the tray support 95, and in addition arranged so that it is also capable of being broken down into a compact storage configuration similar to stand 10*c* shown with reference to FIGS. 30–32. In particular, effects tray 95 has been modified so that it includes a pair of legs which enable such tray to be used to support large, heavy equipment such as an amplifier or speaker without fear of the stand collapsing or tipping over. As will also be shown, use of the tray to support an amplifier or speaker also enables such speaker or amplifier to be positioned at a upward angle so that the sound is directed upwardly rather than directly towards the musician.

Figure 33:
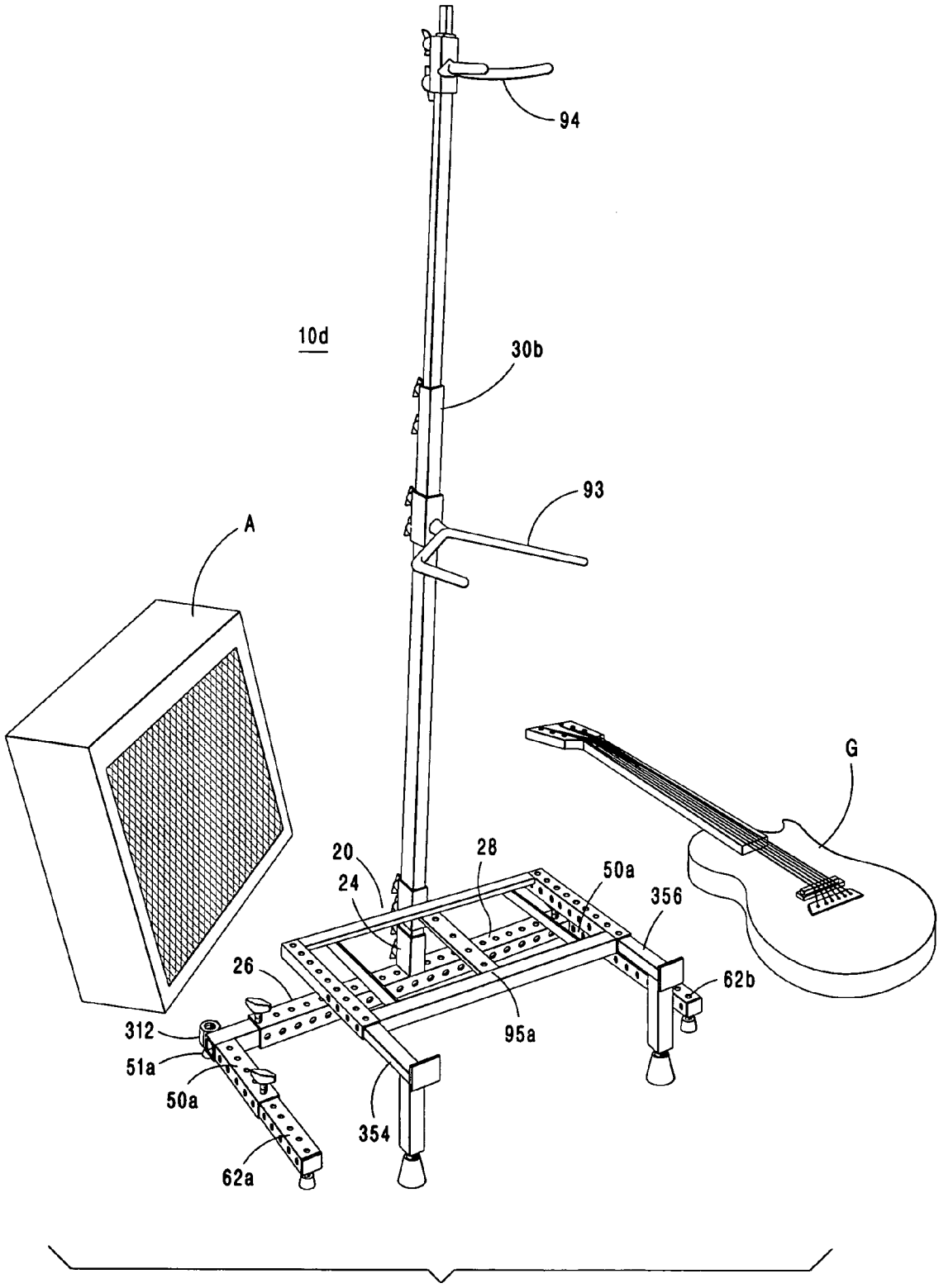
FIG. 33 is a view of another preferred embodiment of the stand of the present invention further having an amplifier support with supplemental support leg members.

Referring now to FIG. 33, illustrated there is an isometric view of the modified instrument and equipment stand 10*d* in an upright configuration ready for use, including the longitudinally and laterally expandable base in accordance with embodiment 10*c* shown in FIGS. 30–32. More particularly, the base 20 has fairly long tubular sections 26 and 28 extending from the central portion of the base 20 under the microphone socket 24, and with L-shaped end or corner members 50*a* and 50*b* completing the end of the base 20 and telescoping legs 62*a* and 62*b* extending from these. As in embodiment 10*c*, to accommodate compact storage of the device as well as to improve the stability of the device, an aperture 312 is provided in the sides or ends 310 and 311 of corner pieces 56*a* and 56*b*, and foot members 51*a* and 51*b* are attached in threaded housings 306 and 307 on corner pieces 56*a* and 56*b*.

Figure 34:
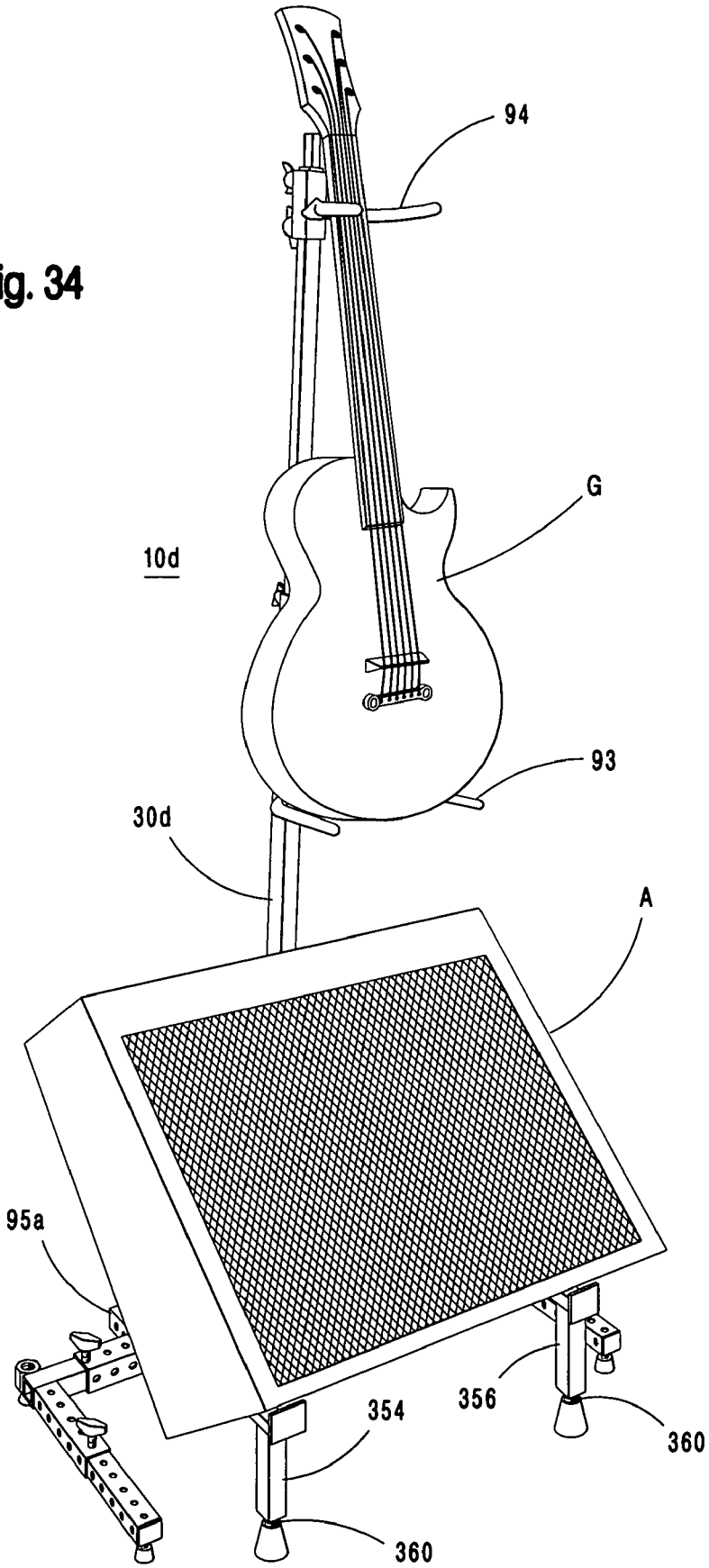
FIG. 34 is a view of the embodiment of the stand of the present invention shown in FIG. 33 supporting a guitar and a large amplifier.

Microphone stand or post 30*b* of a sturdy square tubular type such as shown in FIG. 17 extends upwardly from the socket 24*a*, such stand accommodating a telescoping central square tubular member for expansibility. Attached to stand 30*b* are two instrument brackets 93 and 94 which are fitted over the square tubular member 30*b* and clamped with screw clamps. In addition, tray support 95*a*, also provided with a square tubular clamp which fits over the support rod 30*b*, is clamped to the support rod by wing type threaded clamping means at a desired level. Similar to the arrangement shown in FIGS. 18 and 19, as shown in FIG. 34, brackets 93 and 94 are used to support an instrument such as an electric or acoustic guitar G when such instrument is not in use. In addition, rather than placing amplifier A on the ground as in FIG. 18, such amplifier is placed on tray support 95*a*. Note that such amplifier A could be placed on tray support 95*a* so that it is upright or facing directly forwardly, or as shown in FIG. 34, it may leaned so that the front is pointed upwardly.

Figure 35:
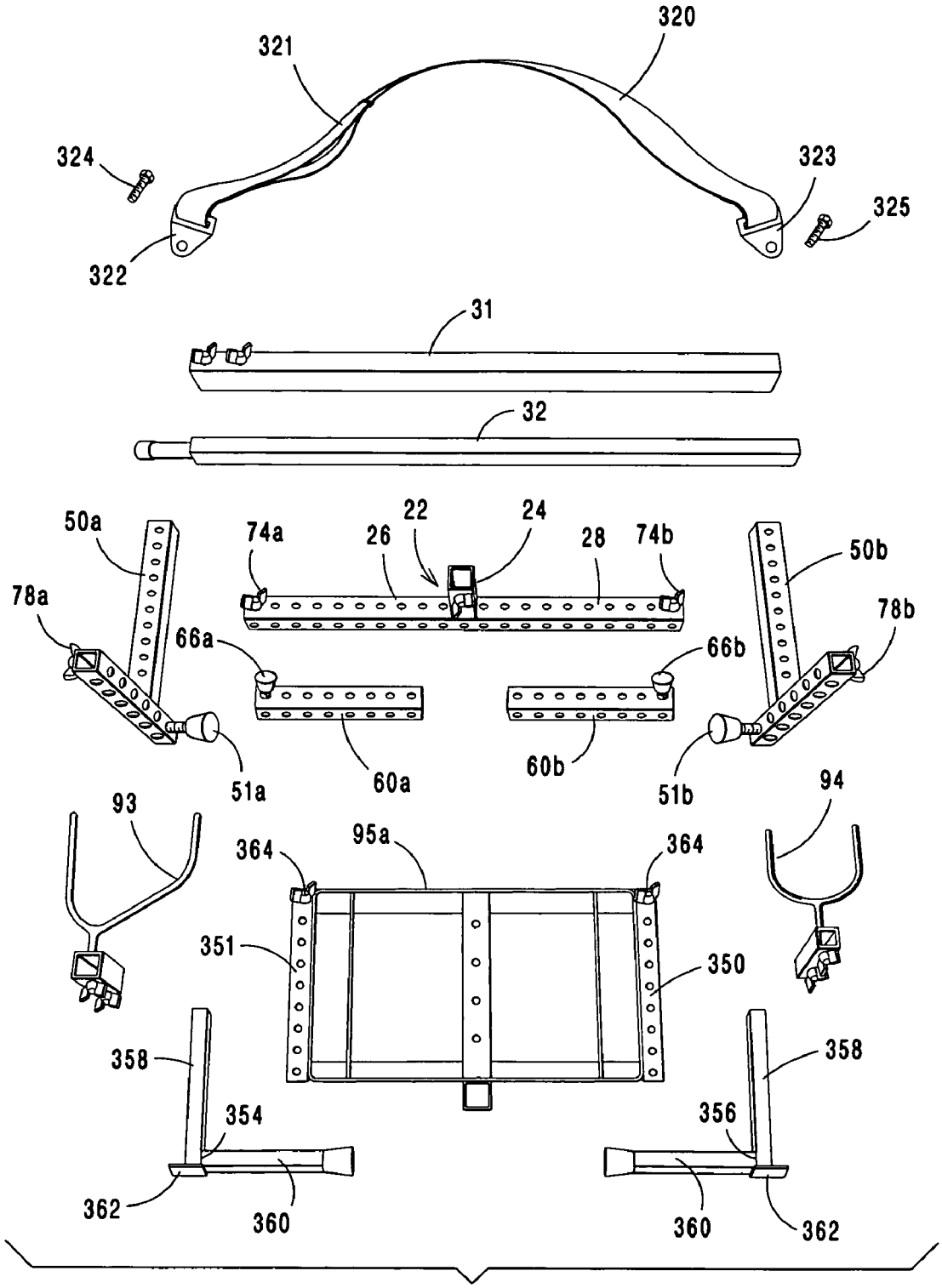
FIG. 35 a view of the parts of the apparatus shown in FIGS. 33–34 laid out ready to be assembled including the modified support tray and supplemental tray support members.

FIG. 35 shows in isometric projection from the front above the parts of the stand 10*d* laid out upon a surface after disassembly. Included is base 20 having center section 22 comprised of tubular sections 26 and 28 which meet at a central point below socket 24, L-shaped corner members 50*a* and 50*b*, telescoping or extensible leg members 60*a* and 60*b*, foot members 51*a*–*b* and 66*a*–*b*, and screw clamps 74*a*–*b* and 78*a*–*b*. Also shown separated are support rod sections 31 and 32, as well as instrument supports 93 and 94, and tray support 95*a*. Tray support 95*a* is different from tray support 95 shown in FIG. 17 in that it includes tubular side members 350 and 351 for attachment of L-shaped support members 354 and 356, respectively. Each L-shaped support member 354 and 356 is comprised of an inner telescoping member 358, a leg member 360 situated substantially a right angle from telescoping member 358, and a stop 362 welded to the outer end of telescoping member 358. As explained below, stops 362 act as a front lip on tray support 95*a* to prevent items placed on the tray support from slipping off. Also provided are screw pins 364 for locking members 358 at a particular telescoping position. The addition of support members 354 and 356 substantially increase the versatility of tray support 95*a* so that it can be used to support larger items such as large amplifiers and speakers without fear of the stand 10*c* tipping or such equipment falling off the front of the tray support. Finally, also shown in FIG. 35 as in the embodiment shown in FIGS. 30–32 is carrying or shoulder strap 320 including a flexible strap section 321 and a pair of metal clip sections 322 and 323 on the ends of said strap section 321 each having an aperture sized so that a screw 324 and 325 can be inserted in such aperture and threadably secured in the upper end of threaded housings 306 and 307, respectively on corner members 50*a* and 50*b*, respectively.

Figure 36:
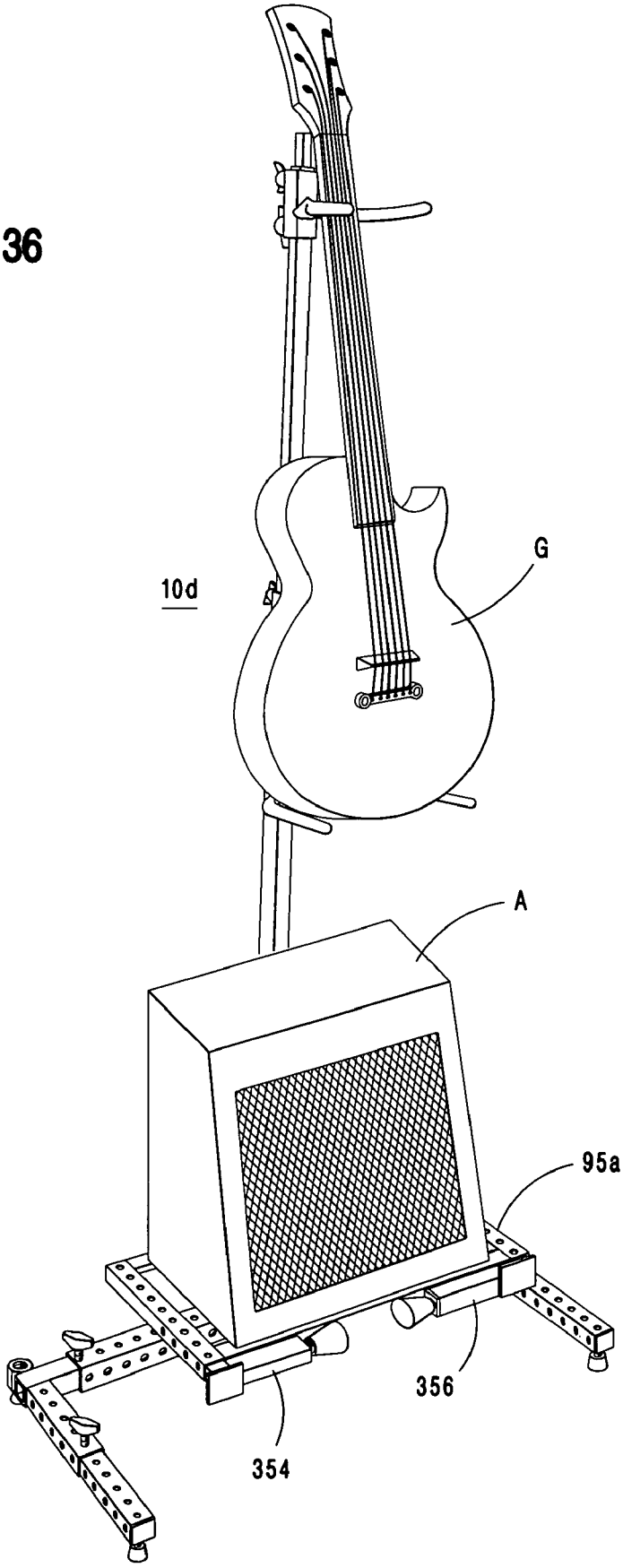
FIG. 36 is another view of the apparatus shown in FIGS. 33–35 being used to support a small amplifier and a guitar.

FIG. 36 illustrates one mode of use of tray support 95*a*, wherein it is used to support a relatively small sized amplifier A completely off the ground as well as a guitar G. Note in FIG. 36 that L-shaped support members 354 and 356 are each shown in a storage position, as they are not required to be used due to the small size of amplifier A. In FIG. 34, however, another mode of use of stand 10*d*, and in particular tray support 95*a*, is illustrated, wherein the tray support is used to support a large sized amplifier or speaker, as well as a guitar. In FIG. 34, tray support 95*a* is moved down lower on rod section 31, such that leg members 360 of L-shape support member 354 and 356 are in contact with the stage or floor surface. To move tray support 95*a* into such position, the threaded pins securing tray 95*a* to rod section 31 are loosened and the tray support is moved to the appropriate height, wherein such pins are again tightened. Pins 364 holding L-shaped support members 354 and 356 to tray 95*a*, assuming they are originally positioned in a storage position as shown in FIG. 36 with the leg members 360 facing inwardly towards one another, are loosened and then telescoping legs 358 are completely removed from tubular side members 350 and 351, respectively. L-support member 354 is then rotated ninety degrees in a clockwise direction so that leg member 360 is touching the stage or floor, and then telescoping member 358 is reinserted into tubular side member 351 and tightened. Similarly, after L-support member 356 is completely removed from tray support 95*a*, it is rotated ninety degrees in a counterclockwise direction so that its leg member 360 is also in contact with the floor surface, after which telescoping member 358 is reinserted into side member 352 and tightened. Then, as shown in FIG. 34, large amplifier or speaker A as well as guitar G can be easily supported on stand 10*d* with little fear of tipping or collapsing, as the additional support member 354 and 356 will stabilize the entire stand by supporting much of the weight of the amplifier or speaker A and in addition giving the stand a wider base.

While stand 10*d* including instrument supports 93 and 94 and tray support 95*a* having additional leg members 354 and 356 result in a particularly sturdy and useful instrument and equipment support apparatus, as with the microphone stand shown in FIGS. 30–32, the inventor has also found that the stand 10*d* including such supports can also be broken down and arranged in a relatively small sized and easy to carry and store package. FIG. 35 illustrates all of the various parts of the stand 10*d* in a broken down configuration, while FIG. 37 illustrates the stand 10*d* compacted into two small packages, and FIG. 38 illustrates stand 10*d* compacted into a single package.

The method of storing the base 20 and support rod 30 portions of stand 10*d* are essentially the same as described above with reference to stand 10*c* shown in FIGS. 30–32. First, the telescoping ends 54*a* and 54*b* of corner members 50*a* and 50*b* are rotated ninety degrees in a counterclockwise direction with respect to the first and second outer sleeves 26 and 28 of central portion 22, and then are reinserted into such outer sleeves, and threaded jam-type screw members 74*a* and 74*b* are tightened to secure corner members 50*a* and 50*b* in such position. As a result, the upwardly protruding stand socket 24 and outwardly extending sleeves 58*a* and 58*b* of corner members 50*a* and 50*b* are now in the same plane and therefore take up less overall storage space. Inner and outer telescoping microphone support member sections 31 and 32 are then unextended and slipped through one of the sides or ends 310 or 311 of corner pieces 56*a* and 56*b* so that the opposite end protrudes out the other side or end 310 or 311. As a result, the entire microphone stand 10*c* may be easily broken down and stored in such compact configuration. Then, carrying or shoulder strap 320 (shown in FIG. 38) including flexible strap section 321 metal clip sections 322 and 323 on the ends of said strap section 321 is attached through apertures in each clip section 322 and 323 to threaded housings 306 and 307 by screws 324 and 325, respectively.

Next, instrument supports 93 and 94 and tray support 95*a* are secured together in a neat package, with the same screw clips that are used to secure the instrument supports to support 31 now being used to secure the supports to tray support 95*a*, also shown in FIGS. 37 and 38. Support 93 is secured so that it is basically flush against the underside of tray support 95*a*, while support 94 is secured so that it is flush with the top surface of tray support 95*a*, with the screw clips being secured in notches in crosspieces that comprise part of the framework or structure of tray support 95*a*. Telescoping portions 358 of L-shaped tray support members 354 and 356 are secured in tubular side members 351 with leg members 360 facing inwardly toward one another rather than downwardly, and pins 364 are again tightened. As indicated above, instrument support bracket 94 is then laid on top of tray support 95*a* as shown in FIG. 37, with the pins of double screw interlock means used to secure connector 158 at a vertical position on support rod 30 now being used to secure the connector 158 to tray 95*a* with such pins situated in cutout sections in cross bar 370 of the tray support 95*a*. The pins are then tightened to secure bracket 93 in place. Similarly, instrument bracket 94, which has a single pin in connector 158, is laid flat on the opposite side of tray support 95*a* and then such pin is tightened in a cutout section of cross bar 378.

Once the combined stand base and rod sections 380 and instrument and equipment support sections 382 of the device have been arranged as just described, as shown in FIG. 38, such sections may then be secured together so that the stand 10*d* with the equipment holding supports is secured in a single compact package. To accomplish this, the combined instrument and support section 382 is first rotated one hundred eighty degrees from its orientation in FIG. 37, and is laid on top of stand base and rod sections 380. Prior to this, however, pins 70 and 72 on socket 24 are removed, so that the combined section 382 can lie flat on combined section 380. Tray support 95*a* includes a central bar 384 having apertures 385 and 386 (see FIG. 37), which are spaced apart so that they can be aligned with the apertures in socket 24. This is done, and then pins 70 and 72 are reinserted through apertures 385 and 386 in bar 384 and then into socket 24 and tightened. This will secure the sections 380 and 382 tightly together so that they can be carried and stored as a single package.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A musical performer's stand base for supporting a generally vertically extending support member for at least one accessory to musical performance including a U-shaped support base having a front and rear side comprising:

(a) a central base portion supporting the vertically extending support member;

(b) a pair of corner members including a first pair of telescoping legs extending from opposite sides of said central portion, a pair of housings for receiving a second pair of telescoping legs at an angle which is perpendicular to said first pair of telescoping legs, and a pair of adjustable foot members provided in housings on the front side of the support base, said corner members and central base portion further being adapted to receive said vertically extending support member when said support member is dismounted for storage purposes, (c) a second pair of telescoping legs extending from said housings in the corner members;

(d) wherein when the telescoping legs are at least partially extended and adjustably dimensioned the U-shaped support has a configuration and dimensions adapted to encompass a directly floor supported apparatus used as an aid in musical performance.

2. The musical performer's stand base in accordance with claim 1 additionally comprising:

(e) first and second instrument support brackets being movably clamped to said vertical support member.

3. The musical performer's stand base in accordance with claim 1 additionally comprising:

(e) a tray support which may be movably clamped to said vertical support member for supporting an amplifier or speaker on said tray support.

4. The musical performer's stand base in accordance with claim 3 additionally comprising first and second telescoping L-shaped support members which are adjustably securable to said tray support and which may be used to adjust the size and holding capacity of said tray support.

5. The musician's stand base in accordance with claim 4 wherein L-shaped support members are comprised of a telescoping member, a leg member connected to said telescoping member at a right angle to said telescoping member, and a stop provided at the outer end of said telescoping member.

6. The musical performer's stand base in accordance with claim 5 wherein said tray support may be adjusted so that said leg members of the L-shaped support member are in contact with the ground surface, thereby providing a more stable base for supporting an amplifier or other equipment on said tray support.

7. The musical performer's stand base in accordance with claim 4 wherein said tray support additionally comprised a pair of tubular side members in which said L-shaped support members are secured.

8. The musical performer's stand base in accordance with claim 1 additionally comprising a carrying strap securable to said U-shaped support base.

9. The musical performer's stand base in accordance with claim 1 additionally comprising a means for temporarily securing said instrument supports to said tray support for storage purposes.

10. The musical performer's stand base in accordance with claim 9 additionally comprising a means for temporarily securing said tray support and having the instruments supports secured thereto to said stand base in a storage position.

* * * * *